US010109155B2

(12) United States Patent
Chase

(10) Patent No.: US 10,109,155 B2
(45) Date of Patent: Oct. 23, 2018

(54) OPERATING A DISTRIBUTED COMPUTER SYSTEM FOR A DURATION-LIMITED POKER TOURNAMENT

(71) Applicant: IGT UK INTERACTIVE LIMITED, London (GB)

(72) Inventor: Ashley P. Chase, Bromley (GB)

(73) Assignee: IGT UK INTERACTIVE LIMITED, London (GB)

( * ) Notice: Subject to any disclaimer, the term of this patent is extended or adjusted under 35 U.S.C. 154(b) by 148 days.

(21) Appl. No.: 15/088,362

(22) Filed: Apr. 1, 2016

(65) Prior Publication Data

US 2016/0321874 A1 Nov. 3, 2016

Related U.S. Application Data

(60) Provisional application No. 62/154,004, filed on Apr. 28, 2015.

(51) Int. Cl.
*A63F 9/00* (2006.01)
*G07F 17/32* (2006.01)

(52) U.S. Cl.
CPC ..... *G07F 17/3276* (2013.01); *G07F 17/3225* (2013.01); *G07F 17/3293* (2013.01)

(58) Field of Classification Search
None
See application file for complete search history.

(56) References Cited

U.S. PATENT DOCUMENTS

2006/0178185 A1* 8/2006 Weis ..... A63F 1/18 463/13

* cited by examiner

*Primary Examiner* — Seng H Lim
(74) *Attorney, Agent, or Firm* — Sage Patent Group

(57) ABSTRACT

Described herein are techniques for operating a distributed computer system to implement a duration-limited online poker tournament. Also described herein are particular techniques for operating a distributed computer system to implement such a duration-limited online poker tournament. In some embodiments, a duration-limited online poker tournament is operated such that each player begins with a set number of funds, but those funds are not themselves used during gameplay. Rather, in the tournament each player is allotted a number of chips and, at an outset of each hand, each player's chips are reset to this number, regardless of the chips won or lost in preceding hands. At the end of the tournament, a player's winnings or losses may be determined based on the chips won or lost across the hands of the tournament.

20 Claims, 10 Drawing Sheets

OPERATING A DISTRIBUTED COMPUTER SYSTEM FOR A DURATION-LIMITED POKER TOURNAMENT

CROSS-REFERENCE TO RELATED APPLICATIONS

This application claims priority under 35 U.S.C. § 119(e) to U.S. Provisional Application Ser. No. 62/154,004, titled "Techniques for calculating prizes in a poker competition," filed on Apr. 28, 2015, which is herein incorporated by reference in its entirety.

FIELD

Embodiments relate to gaming devices, including casino gaming devices or online gaming devices, and to techniques for operating such devices in connection with an online poker tournament that is arranged to be played in a duration-limited manner. In some embodiments, the duration-limited online poker tournament is operated such that a number of chips available to each player during a hand is reset at an outset of each hand, and standings in the tournament are calculated based on performance across all hands.

BACKGROUND

Online gaming and gambling has become an increasingly popular form of entertainment in recent times. Online gaming infrastructures have developed that make use of large networks such as the Internet to connect players together from diverse geographic locations, sometimes around the globe. Connecting to an online gaming site can allow an individual to compete in approximately real-time against other players with whom he would never otherwise come into contact, at arbitrary times of day, from the comfort of his own home or office computer, without having to physically travel to a casino or other brick-and-mortar gaming site.

One of the earliest and most popular wagering games to be played online is poker, which includes a number of variants, such as Texas hold'em, Omaha, Seven-card stud, Razz, HORSE, and others. In a traditional poker card game, players sit together at a table and compete to collect winning combinations of cards. At the beginning of each "hand" of the game, typically one or more of the players are required to place an initial bet of some amount (the "blind" or "ante"), and then cards are dealt to the players. Players take turns betting on the strength of the cards that each of them holds (also called the player's "hand" of cards), placing bets in the form of money, "chips" (game betting pieces representing units of value), or other items of value into a "pot" that will be collected by the winner of the hand. In many poker games, there are multiple rounds of betting, separated by periods during which additional cards may be dealt and/or traded. In each round of betting, a player at his turn may either bet or fold (leave the hand and forfeit his contributions to the pot up to that point). After the final betting round, if multiple players remain without folding, then at least some of their hands of cards are revealed, and the player with the strongest hand (as defined by the game rules) wins the pot. Or, if all players but one have folded, then the remaining player may take the pot, possibly without showing his hand of cards.

In a poker cash game, hands of poker are played where the player's chips represent cash and players are relatively free to join or leave a game as they wish. Betting may be structured such that only certain values of cash bets are allowed at each betting opportunity within a hand, or may be unstructured (so-called "no limit" play) such that a player may bet any number of chips, including all of them, when a betting opportunity arises as defined by the rules of the poker game being played.

In a poker tournament, multiple hands of poker are played in sequence, and the winner of the tournament is typically the player who succeeds in winning all of the chips at play in the tournament (i.e., all of the other players' chips, plus his own starting chips). To participate in the tournament, each player typically pays a fixed buy-in amount and is given a fixed starting number of chips to play with. The chips in a tournament therefore do not represent a cash amount, but rather are a currency within the tournament used to decide who wins and loses the tournament. The buy-ins form a prize pool from which the tournament's winnings are drawn. If there are a large number of players in the tournament, they may begin the tournament divided into multiple tables of players, which may be consolidated into fewer numbers of tables as individual players are eliminated from play. All players other than the winner typically become eliminated at some point during the tournament, by losing all of their chips. Once the tournament has been won, in some cases the winner may be awarded all of the prize money. In other cases, the winner may be awarded the largest portion of the prize money, and one or more other players may be awarded smaller portions based on when they were eliminated from the tournament (e.g., the last player to be eliminated may be awarded the next-largest portion of the prize money, etc.).

Online poker tournaments are typically hosted by a server, such as a web server, to which players from potentially anywhere in the world can connect to play together as if they were in the same room. Each player typically participates in the tournament via a client device (such as a personal computer) that communicates with the server via a network such as the Internet. The server manages and continually updates a database storing the information used in running the online poker tournament, such as user profiles, player chip amounts, player table assignments, player hands, player bets, game cards, and the like. The server transmits information to and receives corresponding information from the client devices in data transmissions via the network. The server device processes information it receives, such as new user actions or user profile changes, updates the database as to the current game state in as close to real-time as possible, and transmits continuously updating graphics and messages to the client devices to maintain on each client device a real-time display of the virtual poker tournament in progress.

SUMMARY

According to some aspects, a method is provided of calculating prize amounts to be awarded to a plurality of players of a poker game, the game having a predetermined duration, the method comprising operating the poker game for a plurality of hands, wherein each player of the plurality of players has an identical number of chips at the start of each hand of the plurality of hands, recording a number of chips won or lost by each player within each hand of the plurality of hands of the poker game, determining that the predetermined duration has elapsed, calculating a score for each player of the plurality of players, each score being based at least in part on a total number of chips won or lost by a respective player within all of the plurality of hands of the poker game, and calculating a prize amount for each player based at least in part on the respective player's score.

According to some aspects, a method is provided of calculating prize amounts to be awarded to a plurality of players of a poker game, the game having a predetermined duration, the method comprising operating the poker game for a plurality of hands, wherein each player of the plurality of players has an identical number of chips at the start of each hand of the plurality of hands, recording a number of chips won or lost by each player within each hand of the plurality of hands of the poker game, determining that the predetermined duration has elapsed, calculating a total number of chips won or lost by each player across all of the plurality of hands of the poker game, calculating a score for each player by adding a predetermined constant value to the total number of chips won or lost by a respective player across all of the plurality of hands of the poker game, and calculating a prize amount for each player based at least in part on the respective player's score.

According to some aspects, a method is provided of calculating prize amounts to be awarded to a plurality of players of a poker game, the game having a predetermined duration, the method comprising operating the poker game for a plurality of hands, wherein each player of the plurality of players has an identical number of chips at the start of each hand of the plurality of hands, recording a number of chips won or lost by each player within each hand of the plurality of hands of the poker game, determining that the predetermined duration has elapsed, calculating a total number of chips won or lost by each player across all of the plurality of hands of the poker game, determining that a first player of the plurality of players has a highest total number of chips lost, calculating the score for each player by adding the first player's total number of chips lost to the total number of chips won or lost by the respective player across all of the plurality of hands of the poker game, and calculating a prize amount for each player based at least in part on the respective player's score.

In some embodiments, the predetermined duration is a time duration.

In some embodiments, the predetermined duration is a number of the plurality of hands.

In some embodiments, calculating the prize amount for each player comprises allocating a portion of a prize pool to each player in accordance with the respective player's score.

In some embodiments, calculating the prize amount for each player comprises ranking the scores for each player and awarding a predetermined prize amount to each player based on the player's ranking.

According to some aspects, a method is provided of operating a system of distributed computers in a duration-limited online poker tournament including a plurality of distributed players for a set period of time, the system of distributed computers comprising a plurality of client devices each operated by a player of the plurality of distributed players. The method comprises receiving, for each player of the plurality of distributed players, an indication of a financial account to be credited based on the player's performance in the duration-limited online poker tournament and interacting with the plurality of distributed players for the set period of time, wherein interacting with the plurality of distributed players comprises playing a plurality of hands of poker. Playing the plurality of hands of poker comprises, for each hand of the plurality of hands, at an outset of the hand and for each player of the plurality of distributed players, resetting, to a default number, a number of chips made available to the player for betting during the hand, wherein resetting to the default number comprises recording, in at least one data store, that a number of chips currently available to each player for betting is equal to the default number, interacting with the plurality of client devices of the plurality of distributed players to present to each player cards that have been dealt to each player and to receive from each player an identification of one or more actions to be taken by the player during the hand, wherein the one or more actions comprise one or more actions related to betting and/or one or more actions related to the player's cards, wherein interacting with the plurality of distributed players comprises exchanging messages with the plurality of client devices via one or more networks, and wherein in a case that an action taken by a player is a betting action, the interacting comprises determining, based on the betting action, an updated value for the number of chips currently available to the player for betting and recording the updated value for the player in the at least one data store, determining, following the interacting with the plurality of distributed players, a winner of the hand in accordance with poker rules for the duration-limited online poker tournament, and recording, for each player, a number of chips won or lost by the player as a result of betting by the player during the hand. The method further comprises determining, following the set period of time for the duration-limited online poker tournament, a score for each player of the plurality of distributed players, wherein determining the score for each player comprises, for each player, evaluating the number of chips won or lost by the player across each hand of the plurality of hands, determining an amount of funds to credit a financial account of each player, of the plurality of distributed players, based on the score for each player, and crediting the financial accounts for the plurality of distributed players based on the amount of funds calculated for each player of the plurality of distributed players.

BRIEF DESCRIPTION OF THE DRAWINGS

The accompanying drawings are not intended to be drawn to scale. In the drawings, each identical or nearly identical component that is illustrated in various figures is represented by a like numeral. For purposes of clarity, not every component may be labeled in every drawing. In the drawings.

DETAILED DESCRIPTION

Figure 1A:
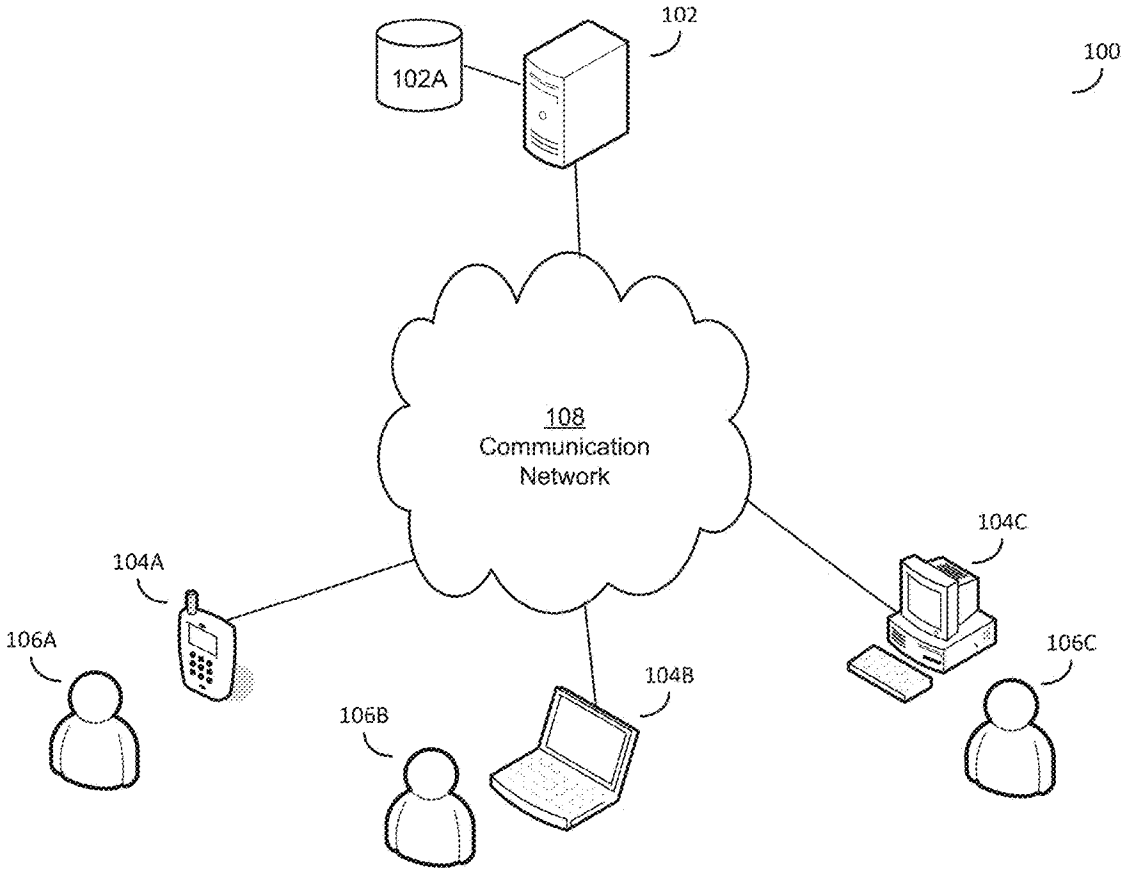
FIG. 1A is a schematic diagram of some components of an example of a computer system with which some embodiments may operate.

Described herein are techniques for operating a distributed computer system to implement a poker system among distributed players, who may be geographically remote from one another. More particularly, embodiments are described below of techniques for operating such a computer system to implement a duration-limited online poker tournament.

In the duration-limited online poker tournament, the distributed players may compete against one another in a poker tournament in a manner that overcomes traditional difficulties with geographically-remote players in poker tournaments. For example, players may avoid conventional online poker tournaments due to the traditionally-indeterminate length of such games. As another example, when players are geographically remote from one another and competing via the Internet, the players may not feel any obligation to one another and players may leave a game prematurely when they are "up" (have more money than they started with), which denies "down" players an opportunity to win back some of their funds. This practice may further discourage players from engaging in online poker tournaments via distributed systems.

Also described herein are particular techniques for operating a distributed computer system to implement such a duration-limited online poker tournament. As should be appreciated from the foregoing, in conventional poker tournaments, players begin the tournament with a set number of funds for the tournament and, through each hand, each player wins or loses funds, with players being eliminated from the tournament when their funds are exhausted. In contrast, in some embodiments, a duration-limited online poker tournament is operated such that each player begins with a set number of funds, but those funds are not themselves used during gameplay. Rather, in the tournament each player is allotted a number of chips and, at an outset of each hand, each player's chips are reset to this number, regardless of the chips won or lost in preceding hands. At the end of the tournament, a player's winnings or losses may be determined based on the chips won or lost across the hands of the tournament.

The inventor has recognized and appreciated that conventional poker games suffer from at least one of two problems. First, while poker tournaments offer the prospect of gameplay with a fixed cost for play, there is uncertainty as to how long a player will be able to participate. Each player may pay the same amount to enter the tournament, but each player has a risk of being eliminated at any point during the tournament, perhaps even during the very first hand. Even if the player is able to survive in the tournament, there is no guarantee that the experience will be enjoyable, as a player with fewer chips at the table (sometimes called a "short stack") can often find it difficult to make gains in a conventional tournament due to the higher leverage that a large chip stack provides. In games with forced betting (e.g., antes, blinds), such bets can whittle away at a short stack making it even harder for the short stack to make gains on the other players.

On the other hand, poker cash games provide relative certainty as to how long a player can play, as the player is free to cash out and leave the game at any time. However, the total cost of play is not known beforehand, as the player could end up placing a lot of large bets or only a few small bets, and as these bets come directly from the player's funds the player cannot know ahead of time how much money he might stand to lose while playing.

Accordingly, neither conventional tournament play nor cash games offers both a fixed maximum expenditure and a known duration of play, both of which are desirable qualities to players who want to limit their possible losses whilst also enjoying playing poker for a known period of time.

The inventor has developed a novel poker tournament format that provides both a fixed maximum expenditure and a known duration of play. Players pay a fixed amount to participate in the tournament, and players play with chips as in a conventional tournament. However, at the start of each hand each player's chip count is reset to a preset amount. Players cannot be eliminated, even if they lose all of their chips during a hand. Any chips won or lost during a hand are recorded (e.g., by recording the change in the player's chip total and/or by recording the chip totals themselves). When the tournament ends, the total amount of chips won and/or lost by a player across all of the hands played during the tournament are summed to produce a score for the player. Prizes are then awarded to players based on their scores and the available prize pool (e.g., the total amount paid by all players, which may be modified by a rake amount).

According to some embodiments, a tournament having the format described herein may have a known duration that is a length of time (e.g., 45 minutes). After the tournament begins, it will end after the length of time has elapsed (e.g., immediately, or after a hand being played is completed). According to some embodiments, a tournament having the format described herein may have a known duration that is a number of hands (e.g., 30 hands). After the tournament begins, it will end after the predefined number of hands has been played. In either case, as discussed above, this provides players with relative certainty as to how long they will be playing since players cannot be eliminated before the known duration has elapsed. Since players cannot be left with a short stack over multiple hands due to the chip stack being reset at the start of each hand, this ensures that players can know going into the tournament that they will be able to fully participate throughout the entire duration of the tournament.

According to some embodiments, a win experienced by one player should result in a loss experienced by another player, and accordingly the scores for all players will total to zero. Scores may be calculated while a tournament is ongoing and/or at the end of the tournament. Providing scores whilst the tournament is being played may provide players with an indication of how well they are performing against the other players.

According to some embodiments, player's scores are ranked at the conclusion of a tournament and prizes are determined for each player by matching the rankings against a prize structure presented prior to the beginning of the tournament. The player with the highest score (e.g., first ranked) may receive a first fixed fraction of the prize pool, the player with the second highest score may receive a second smaller fixed fraction of the prize pool, etc. For example, the player with the highest score may receive 40% of the available prize pool (e.g., the total amount paid by all players to enter the tournament, or the total amount paid by all players minus a rake amount).

According to some embodiments, prizes are calculated for each player based on the score value. In the ranking approach described above, the score is used only insomuch as it determines the player's order in the score rankings. In some cases, however, the score may be used more directly to calculate the player's prize.

According to some embodiments, a constant value is added to each player's score at the end of the tournament to produce an adjusted score. A portion of the available prize pool is allocated to each player in proportion to the player's adjusted score.

According to some embodiments, the lowest score amongst the players is calculated and added to each player's score to produce adjusted scores. Thus, the player having the lowest score will have an adjusted score equal to zero. A portion of the available prize pool is then allocated to each player in proportion to the player's adjusted score.

Approaches to distribution of an available prize pool that are based on the player's score values may have several advantages over approaches that distribute the prize pool based on the rankings of the player's scores. In a system in which only the player's ranking, rather than the absolute value of their score, determines their prize, a player who has a ranking that would not result in a prize (or would only result in a small prize) has little to lose by engaging in risky playing tactics, especially towards the end of a tournament. Since any losses they subsequent suffer would not substantially alter their ranking, the player may gain but will not lose by engaging in risky tactics (e.g., repeatedly making large bets without having a good hand). Since this will inevitably be the case for several players towards the end of a tournament, when a ranking approach to prize distribution is followed, it can be expected that several players will "go for broke" in the end stages of the tournament. This may cause reduced enjoyment for the other players.

In contrast, where a player's score does directly imply a prize amount, the player does have something to lose in that further losses will further reduce the player's possible prize. This will likely curtail or eliminate such risky playing tactics later in the tournament, thereby avoiding the potential reduced enjoyment caused by such tactics to other players. Examples of each of these types of scoring are described in further detail below.

FIG. 1A illustrates an example of a computer system with which some embodiments may operate. The computer system 100 of FIG. 1A includes one or more computing devices 102 configured to operate an online poker tournament as well as a plurality of client computing devices 104 (including devices 104A, 104B, and 104C, generically or collectively referred to as device/devices 104) configured to interact with the device(s) 102 on behalf of human users 106 to play the online poker tournament.

Devices 104 are shown as a mobile phone, a laptop personal computer, and a desktop personal computer, but it should be appreciated that embodiments are not limited to operating with any particular form of client device. In some embodiments, one or more of the devices 104 may be a casino gaming device, such as the devices described below in connection with FIGS. 1B-1D.

The computing device 102 may be implemented as a set of one or more servers, or as any other suitable computing device. The device 102 may execute a tournament facility, which may be implemented as executable instructions that, when executed by the device 102, cause the device 102 to operate the poker tournament, including by interacting with client devices 104. In some embodiments, the tournament facility (or multiple tournament facilities executing in parallel) may cause the device(s) 102 to operate multiple online poker tournaments in parallel, each of which may include multiple players. In some embodiments, all of the online poker tournaments may be operated in a duration-limited fashion as described herein, though in other embodiments input from a player and/or an administrator may set whether the tournament is to be played in a duration-limited fashion or in a traditional fashion. Accordingly, in some embodiments, the device 102 may operate, in parallel, multiple poker tournaments, some of which may operate according to techniques described herein for a duration-limited online poker tournament.

The device 102 may include a data store 102A, which may store information on the poker tournament. The information on the poker tournament may include information on funds available to players, such as funds credited to each player's account with an online poker service. The information on the poker tournament may additionally include information on a current state of the poker tournament, which may include information on a state of a current hand of the tournament. The information on a state of the tournament may include whether the tournament is to be played as a duration-limited tournament, a duration of the duration-limited tournament (specified as, for example, time or a number of hands), information on a buy-in of funds provided by each player to join the tournament, information a number of chips with which each player is to start each hand, a number of chips won or lost by each player in hands that have been completed in the tournament, a running score for each player during the tournament, and a manner in which to assess player performance during the tournament and award funds. The information on a state of a hand may include information on cards held by each player, bets currently made by players, and a number of chips remaining to each player during a hand. In some embodiments in which poker may be played with different rules (e.g., stud poker vs. hold'em poker), the information on a tournament and/or hand may additionally indicate poker rules by which the tournament or hand will be run.

Each client device 104 is operated by a different human user 106 (e.g., user 106A, 106B, 106C, generically or collectively referred to as user/users 106). In addition to the human users 106, the server(s) 102 may additionally execute a facility to operate as one or more computer-implemented players in the poker tournament, which may engage in the poker tournament without human intervention. Such computer-implemented players may be implemented according to known techniques for computer-implemented poker players and may engage in the poker tournament in the same manner as human players.

The device 102 may be connected to the devices 104 via any suitable one or more, wired and/or wireless communication networks 108. The players may be distributed, such that the players may not be sitting at a same card table. For example, some or all of the players may be distributed within a building, such as by being at different machines within a casino. As another example, some or all of the players may be geographically distributed, such that they are geographically remote from one another. In addition, in some embodiments some or all of the players (even players located within a same building) may be geographically remote from the device 102. For example, the device 102 may be located in one building (e.g., a data center) that is geographically remote from another building (e.g., a casino)

in which the players are distributed. Accordingly, the network 108 may, in some embodiments, include the Internet. The device 102 may communicate with the devices 104 via the network 108 as part of operating the poker tournament, such as by interacting with players and receiving from the devices 104 information regarding actions to be taken by players in the tournament. The actions may include, for example, actions related to betting and actions related to betting and/or to a player's cards (e.g., whether to discard a card and pick up a new card, as is permitted in some forms of poker).

Figure 1B:
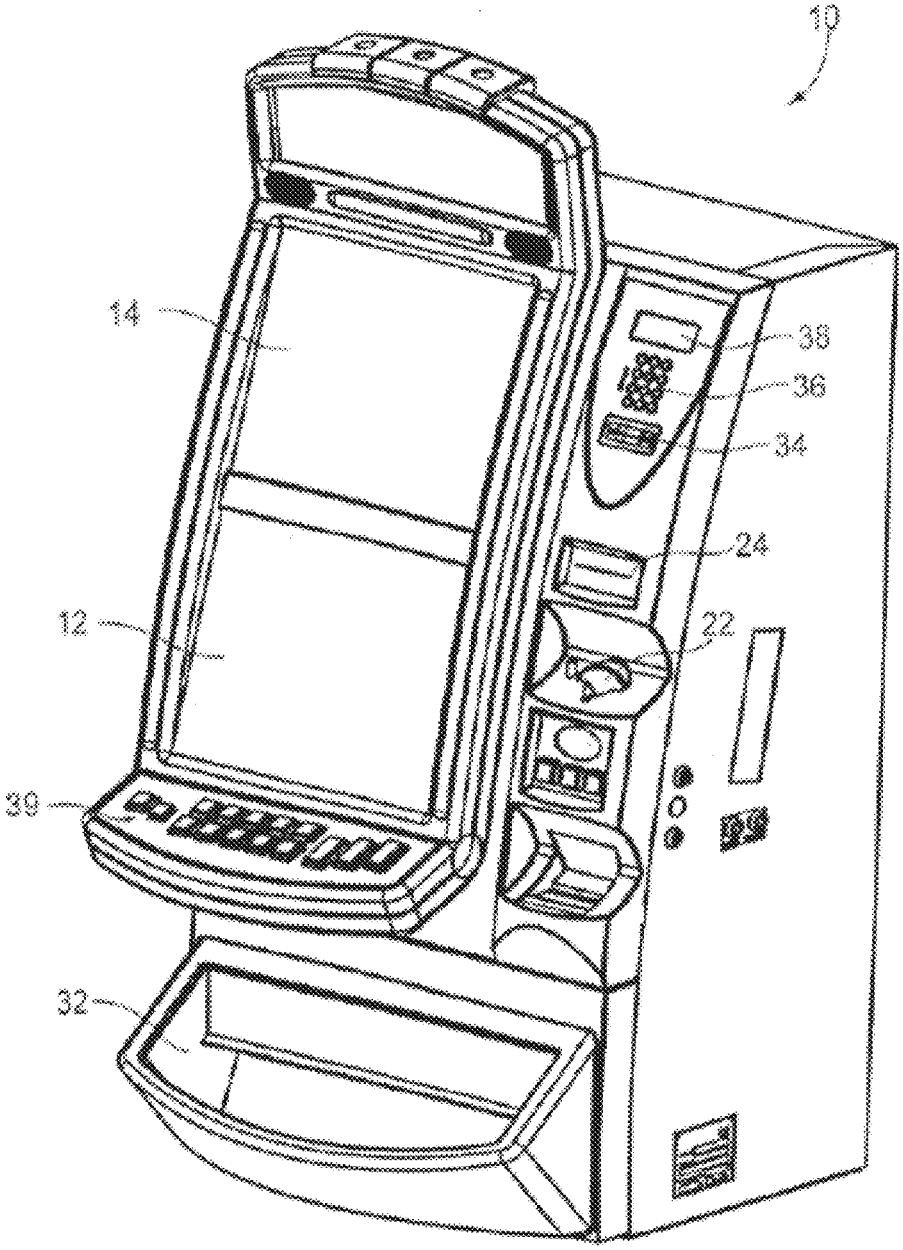
FIG. 1B is an illustration of an example of a computing device with which some embodiments may operate.

FIG. 1B shows a perspective view of an exemplary cabinet housing a casino game machine 10 that may be implemented as a computing device 104 of FIG. 1A in accordance with some embodiments. Exemplary cabinet game machine 10, as depicted in FIG. 1B, includes a display 12, a second display 14, a coin slot 22, a coin tray 32, a card reader slot 34, a keypad 36, and player control buttons 39.

Display 12 may include at least one three-dimensional (3D) display for displaying 3D images of one or more 3D environments (e.g., virtual or real-world 3D environments). Embodiments of the 3D display device may be implemented using any suitable type of display component, including, without limitation, a thin film transistor (TFT) display, a liquid crystal display (LCD), a cathode ray tube (CRT) display, a light-emitting diode (LED) display, and/or an organic LED (OLED) display.

In some embodiments, the 3D display device may be a stereoscopic display, an autostereoscopic display, a holographic display, a volumetric display, a compressive light field display, a side-by-side viewing display, a display with filter arrays, and/or any other suitable 3D display. In embodiments where the 3D display device includes an autostereoscopic display, the autostereoscopic display may include any suitable component(s) for directing images to specified viewers or viewing regions, including, without limitation, a parallax barrier, a lenticular lens, and/or an integral imaging array. In embodiments where the 3D display device includes a stereoscopic display, the stereoscopic display may include any suitable viewing device, including, without limitation, any suitable active 3D viewer or passive 3D viewer.

In some embodiments, the 3D display device may display any suitable type of 3D image using any suitable technique, including, without limitation, anaglyph images, polarized projections, autostereoscopic images, computer-generated holograms, volumetric images, infra-red laser projections, auto stereograms, pulfrich effects, prismatic and self-masking crossview glasses, lenticular prints, wiggle stereoscopy, active 3D viewers (e.g., liquid crystal shutter glasses, red eye shutter glasses, virtual reality headsets, personal media viewers, etc.), and/or passive 3D viewers (e.g., linearly polarized glasses, circularly polarized glasses, interference filter technology glasses, complementary color anaglyphs, compensating diopter glasses for red-cyan method, ColorCode 3D, ChromaDepth method and glasses, Anachrome compatible color anaglyph method, etc.). In some embodiments, the 3D display device may comprise a display manufactured by SeeFront GmbH.

Second display 14 may provide game data or other information in addition to the information provided by display 12. Display 14 may provide static information, such as an advertisement for the game, the rules of the game, pay tables, pay lines, and/or other information, and/or may even display the main game or a bonus game along with display 12. Alternatively, the area for display 14 may be a display glass for conveying information about the game. In some embodiments, display 12 may include a camera for use, for example, in generating and/or displaying autostereoscopic 3D images.

Display 12 and/or display 14 may have a touch screen lamination that includes a transparent grid of conductors. A player touching the screen may change the capacitance between the conductors, and thereby the X-Y location of the touch on the screen may be determined. A processor within cabinet 10 may associate this X-Y location with a function to be performed. There may be an upper and lower multi-touch screen in accordance with some embodiments.

The casino game machine 10 may include one or more inputs and/or input devices (which may be referred to herein as a "reading device") to receive an instrument supplied by a player for conveying a monetary amount. For example, the reading device may include an optical reader, a magnetic/inductive reader, or other type of reader. In some cases, the casino game machine 10 may include a slot by which to receive an instrument.

In some embodiments, the inputs may include a coin slot 22 that may accept coins or tokens in one or more denominations to generate credits within the casino game machine for playing games. An input slot 24 for an optical reader and printer may receive machine readable printed tickets and may output printed tickets for use in cashless gaming.

The casino game machine 10 may also include a coin tray 32 may receive coins or tokens from a hopper (not shown) upon a win or upon the player cashing out. While not explicitly illustrated in FIG. 1B, the casino game machine 10 may further include a banknote detector and a slot through which to receive banknotes in one or more denominations to generate credits within the casino game machine for playing games. The casino game machine may further include a slot by which to output banknotes from a reserve of banknotes (not shown) upon a win or upon the player cashing out.

However, in some embodiments, the casino game machine may not pay in cash, but may only issue a printed ticket for cashing in elsewhere. Alternatively, a stored value card may be loaded with credits based on a win, or may enable the assignment of credits to an account associated with a computer system, which may be a computer network-connected computer system.

In some embodiments, the inputs may include a card reader slot 34 that may accept any of various types of cards, such as smart cards, magnetic strip cards, and/or other types of cards conveying machine readable information. The card reader may read the inserted card for player and/or credit information for cashless gaming. The card reader may read a magnetic code on a conventional player tracking card, where the code uniquely identifies the player to the host system. The code may be cross-referenced by the host system to any data related to the player, and such data may affect the games offered to the player by the casino game machine. The card reader may also include an optical reader and printer for reading and printing coded barcodes and other information on a paper ticket.

A card may also include credentials that enable the host system to access one or more accounts associated with a user, which may be accounts with the casino game machine or with an entertainment system of which the casino game machine is a part, and/or accounts with a financial institution such as a bank or issuer of a credit card. In a case that an account is associated with a financial institution, the casino game machine may generate credits within the casino game machine and/or within an account of the casino game machine for playing games, based on an amount charged by a user to the financial institution account. The account with the casino game machine/system may be debited based on wagers by a user, and credited based on a win.

The casino gaming machine may operate with any suitable type of card with the card reader slot 34 or printing/issuing a card for payout. The card may include a magnetic strip, an RFID tag, an electronic chip, an electronic display (such as an electrophoretic display) that displays a bar code or other identifier, or other electronically-readable card. As discussed above, the card may be associated with credentials, such as credentials for an account with the casino game machine or with an entertainment system of which the casino game machine is a part, and/or accounts with a financial institution.

A keypad 36 may accept player input, such as a personal identification number (PIN) and/or any other player information. A display 38 above keypad 36 may display a menu for instructions and/or other information, and/or may provide visual feedback of the keys pressed. The keypad 36 may be an input device such as a touchscreen, or dynamic digital button panel, in accordance with some embodiments.

Player control buttons 39 may include any buttons and/or other controllers usable for the play of the particular game or games offered by the casino game machine, including, for example, a bet button, a repeat bet button, a spin reels (or play) button, a maximum bet button, a cash-out button, a display pay lines button, a display payout tables button, select icon buttons, and/or any other suitable button(s). In some embodiments, buttons 39 may be replaced by a touch screen with virtual buttons. In some embodiments, touchless control gesture functionality may replace or coexist with buttons 39.

Although embodiments have been described in which a 3D display device is included in a cabinet 10 housing a casino game machine, some embodiments are not limited in this manner. Some embodiments may be implemented using any suitable 3D display device, whether standing alone or included in another device (e.g., a 3D television, a mobile computing device, a head-mounted display, a cabinet housing a casino game machine 10, or any other suitable device).

Figure 1C:
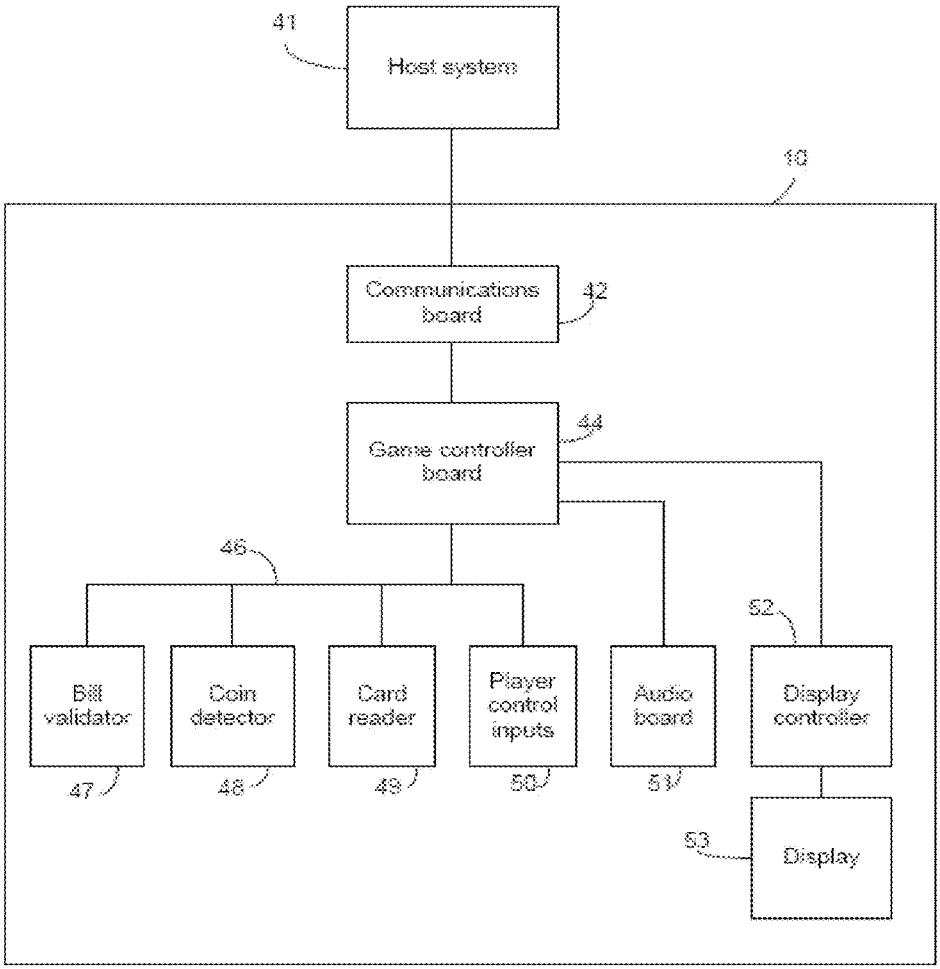
FIG. 1C is a block diagram of some examples of components of a computing device with which some embodiments may operate.

FIG. 1C is a block diagram of an exemplary casino game machine 10 (such as may be housed in the exemplary cabinet shown in FIG. 1B) linked to a casino's host system 41, in accordance with some embodiments. In the example shown, a communications board 42 may contain circuitry for coupling the casino game machine 100 to a local area network (LAN) and/or other type of network using any suitable protocol, such as the G2S protocols. Internet protocols are typically used for such communication under the G2S standard, incorporated herein by reference. Communications board 42 may transmit using a wireless transmitter, and/or may be directly connected to a network running through the casino (e.g., throughout the casino floor). Communications board 42 may set up a communication link with a master controller and may buffer data between the network and game controller board 44. Communications board 42 may also communicate with a network server, such as in accordance with the G2S standard, for exchanging information to carry out embodiments described herein.

Game controller board 44 may contain memory and one or more processors for carrying out programs stored in the memory and for providing the information requested by the network. Game controller board 44 may execute programs stored in the memory and/or instructions received from host system 41 to carry out game routines. In some embodiments, game controller board 44 may execute programs stored in the memory and/or instructions received from host system 41 to perform one or more techniques described herein (e.g., techniques for generating 3D images and/or techniques for controlling a 3D display device to display 3D images). In some embodiments, game controller board 44 may execute programs stored in the memory and/or instructions received from host system 41 to perform one or more tasks described herein.

Peripheral devices/boards may communicate with game controller board 44 via a bus 46 using, for example, an RS-232 interface. Such peripherals may include a bill validator 47, a coin detector 48, a smart card reader and/or other type of credit card reader 49, and/or player control inputs 50 (such as buttons 39 and/or a touch screen).

Game controller board 44 may also control one or more devices that produce the game output including audio and video output associated with a particular game that is presented to the user. For example, audio board 51 may convert coded signals into analog signals for driving speakers. Display controller 52 may convert coded signals into pixel signals for one or more displays 53 (e.g., display 12 and/or display 14). Display controller 52 and audio board 51 may be directly connected to parallel ports on game controller board 44. In some embodiments, the electronics on the various boards may be combined in any suitable way, such as onto a single board. Casino game machine 10 may be implemented using one or more computers; an example of a suitable computer is described below.

Figure 1D:
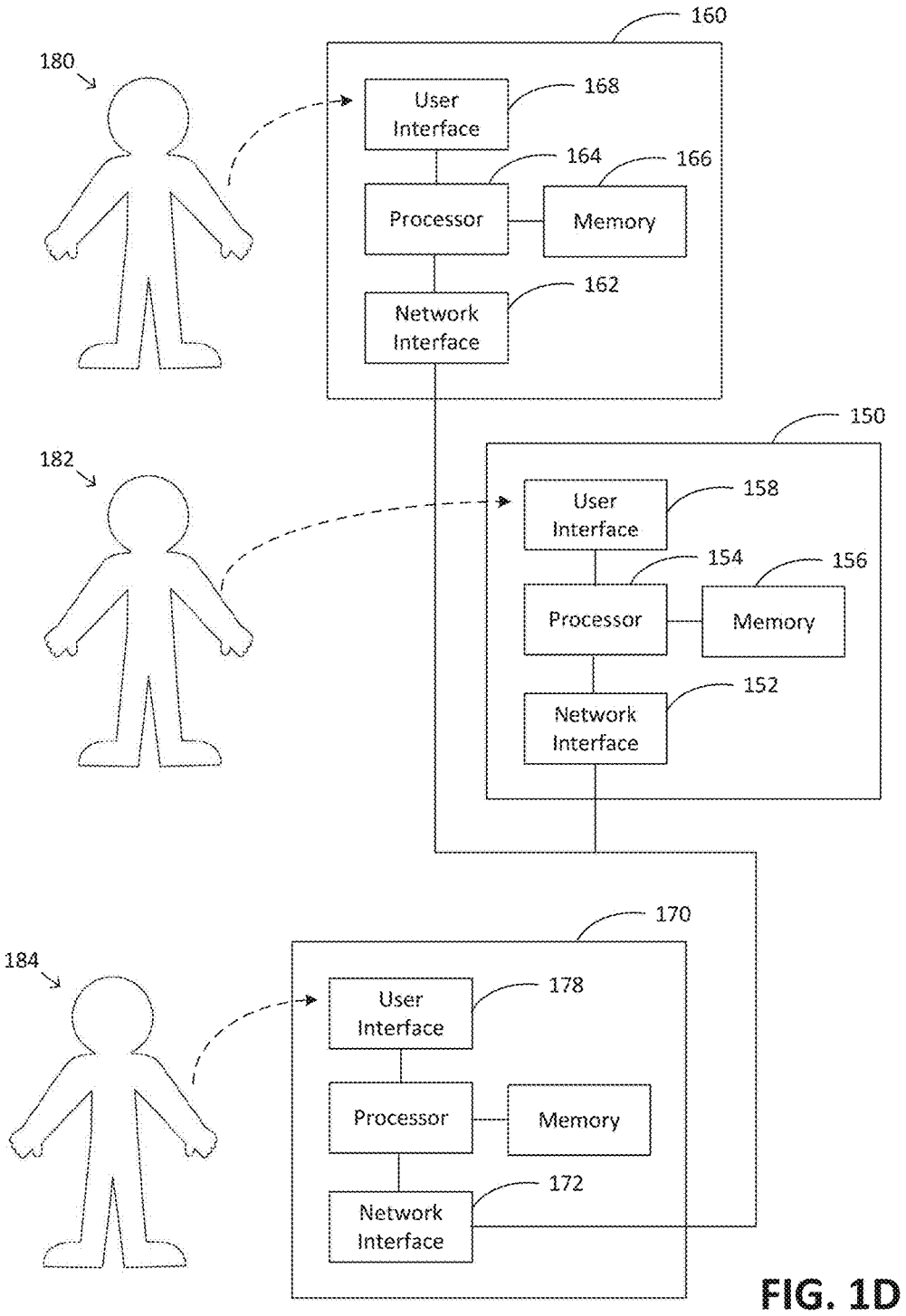
FIG. 1D is a block diagram of some examples of components of a computing environment with which some embodiments may operate.

FIG. 1D illustrates an operating environment including an exemplary control system 160 that may be used in some embodiments to control a casino game machine, such as exemplary casino game machine 10 of FIGS. 1B-1C, in accordance with one or more embodiments. Control system 160 may be implemented in any suitable form, as embodiments are not limited in this respect. For example, control system 160 may be implemented as a single stand-alone machine, or may be implemented by multiple distributed machines that share processing tasks in any suitable manner. Control system 160 may be implemented as one or more computers; an example of a suitable computer is described below.

In some embodiments, control system 160 may include one or more tangible, non-transitory processor-readable storage devices storing processor-executable instructions, and one or more processors that execute the processor-executable instructions to perform one or more tasks and/or processes described herein, including, but not limited to, image-generation tasks and/or processes, display-control tasks and/or processes, etc. The storage devices may be implemented as computer-readable storage media (i.e., tangible, non-transitory computer-readable media) encoded with the processor-executable instructions; examples of suitable computer-readable storage media are discussed below. An example of a suitable storage medium is memory 166 depicted in FIG. 1D, which is operatively connected to processor 164 for executing instructions stored in memory 166. In one example, processor 164 and memory 166 may be a processor and memory contained in game controller board 44, which may provide functionality for operating one or more games on casino game machine 10, in addition to providing control functionality described herein. In another example, processor 164 and/or memory 166 may be separate from game controller board 44 and may assert control signals upon game controller board 44 for affecting the operation of game controller board 44 in operating one or more games on casino game machine 10. When components of control system 160 are separate from components of casino game machine 10 described above, the components of control system 160 may be housed in any suitable location in any suitable configuration, within and/or attached to a cabinet and/or separated therefrom.

Exemplary control system 160 also includes a user interface component 168 configured to allow a user (player) 180 to interact with the casino game machine. User interface component 168 may be implemented in any suitable form, as embodiments are not limited in this respect. In some embodiments, user interface component 168 may be configured to receive input from player 180 in any suitable form, such as by button, touchscreen, touchless control gesture, speech commands, etc., and may be configured to provide output to player 180 in any suitable form, such as audio output and/or visual output on a 2D or 3D display. In one exemplary embodiment, user interface component 168 may include one or more components of casino game machine 10 housed in a cabinet, such as player control inputs 50, audio board 51, display controller 52, and/or displays 53.

FIG. 1D further illustrates an example of a casino environment including a central control system 150 having an interface 152 for wired and/or wireless communication with local control systems for casino game machines 160 and 170 (and possibly other casino game machines) via their respective network interfaces 162 and 172. Exemplary central control system 150 includes one or more processors 154 and memory 156 (e.g., one or more processor-readable storage media) storing processor-executable instructions for causing processor 154 to perform functions such as transmitting control commands to casino game machines 160 and 170. For example, central control system 150 may, through execution by processor 154 of stored program instructions, stream game content to casino game machines 160 and 170 and/or instruct casino game machines 160 and 170 to implement game adjustments selected by central control system 150 at times determined by central control system 150. In various embodiments, gaming functionality may be distributed between central control system 150 and game machine terminals such as 160 and 170 in any suitable way, making use of any suitable division of functionality. For instance, in some exemplary embodiments, central control system 150 may download games to game machine terminals 160 and/or 170, which may execute the game programs including performing random number generation for determining probabilistic symbol outcomes. In other exemplary embodiments, central control system 150 may perform random number generation and execute game programs for game machine terminals 160 and/or 170, which may merely display output (e.g., 3D images) received from central control system 150 and collect user input from users 180 and 180 via user interfaces 168 and 178 for transmission to central control system 150 via the network interfaces. In some embodiments, central control system 150 may have its own user interface 158 for interaction with a user 182. In some embodiments, central control system 150 may also be configured to function as a casino game machine with player interaction capabilities. However, in other embodiments, central control system 150 may simply function as a server providing functions to other casino game machines such as 160 and 170.

Figure 1E:
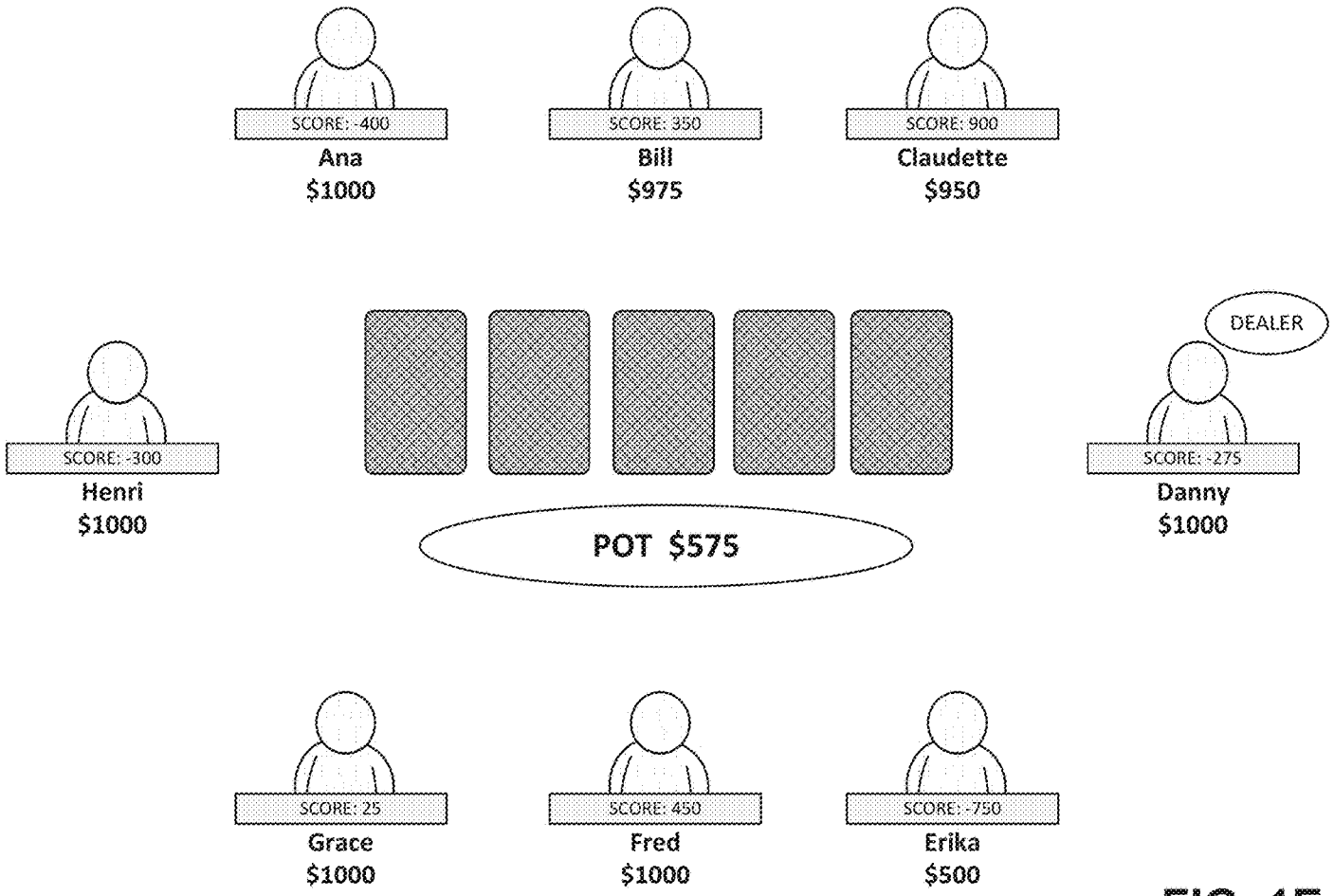
FIG. 1E is an illustration of players in a poker tournament with which some embodiments may operate.

FIG. 1E depicts an illustrative poker tournament in which eight players are participating, according to some embodiments. In the example of FIG. 1E, the players' chip counts reset to $1000 at the start of every hand. In the hand being played shown in FIG. 1E, Danny is the dealer and Bill and Claudette have put forced bets ("blinds") into the pot of $25 and $50, respectively. Erika has opened with a bet of $500, thereby producing a pot having a total of $575. Fred will be next to act.

In the example of FIG. 1E, several hands have previously been played as reflected by the scores of the players shown next to each player's name (players begin the tournament with scores of zero). These scores reflect the total amount won and/or lost summed together over the hands previously played. For example, Ana has a score of −400. This score may, for example, be due to Ana having won a net amount of 100 chips during one hand, and having lost a net amount of 500 chips during another hand. Since the chip amounts reset at the start of each hand, Ana currently has a stack of $1000. As any net chips lost by one player during a hand were won by another player, the scores of the eight players shown in FIG. 1E total zero.

If the tournament were to end with the scores shown in FIG. 1E, Claudette would be awarded the largest prize as she has the highest score of 900. Erika would receive the smallest prize (which may be zero) as she has the lowest score of −750.

Figure 1F:
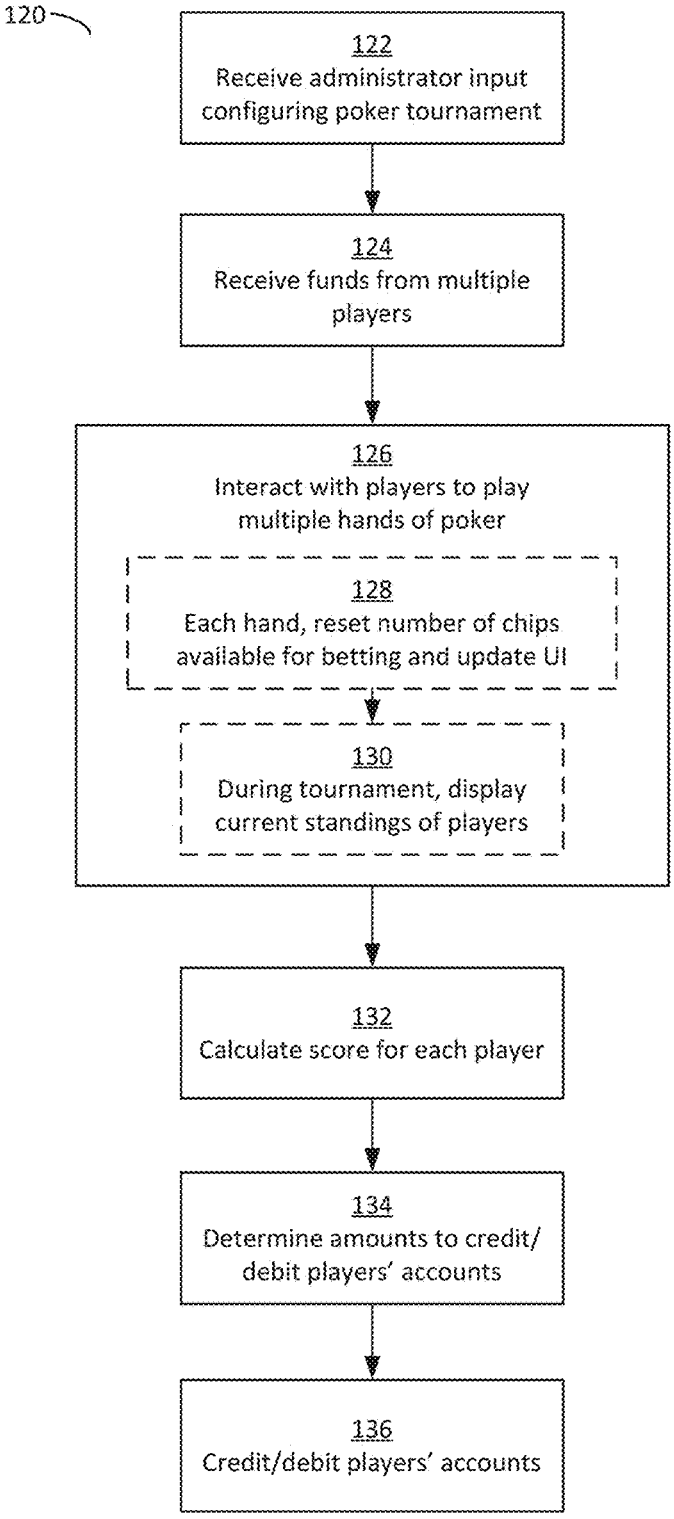
FIG. 1F is a flowchart of a process that may be implemented in some embodiments for operating a distributed computer system to carry out a duration-limit poker tournament.

FIG. 1F is a flow chart showing an example of a process that may be implemented in some embodiments for operating a duration-limited online poker game. The process 120 of FIG. 1F begins in block 122, in which a tournament facility receives administrator input configuring a poker tournament. The administrator input may be received from an administrator of a computer system, such as a person associated with an entity that owns and/or operates computing device 102 of the exemplary computer system of FIG. 1A. The administrator input may additionally or alternatively be received from a player who is organizing a poker tournament via such a computer system, such as a player who has triggers creation of a poker tournament in a system that hosts multiple such poker tournaments. The player who triggers creation may serve as an administrator for configuring the poker tournament.

The input received in block 122 may include settings for the poker tournament. Such settings may include a style of poker to be played, such as stud poker or hold'em poker. The settings may additionally include an amount of funds necessary for a player to buy in to the poker tournament. The settings may include a default number of chips to be provided to each player at an outset of each hand of the tournament, and a length for the duration-limited tournament is to be played (e.g., an amount of time or a number of hands). The settings may further identify an amount of funds to pay out as a result of the poker tournament and a manner in which to determine an amount of funds to award to winning players, such as by selecting between techniques described below in connection with FIGS. 2-4.

In block 124, the tournament facility receives from players funds contributed toward buying in for the tournament. The facility may receive the funds in any suitable manner, including by receiving an identification of a financial account from which the funds are to be debited. The financial account may be one managed by an entity that manages the online poker facility, or a financial account managed by an outside financial entity (e.g., a bank, a revolving credit account, or other financial account).

Receiving the funds in block 124 may include receiving an indication of a financial account from which the funds are to be drawn. Receiving an indication of a financial account may be carried out in any suitable manner, including by receiving payment via a user interface of a computing device that is operated by a player. The user interface may enable a player to enter information about a financial account, such as by providing an account number. In some embodiments, the computing device may include a payment interface and receiving the indication of the financial account may include receiving the indication via the payment interface. The payment interface may be any suitable interface, including a payment slot (e.g., coin slot, cash slot, payment card reader, as discussed above).

In some embodiments, rather than receiving the funds, in block 124 the tournament facility may receive the indication of the account for which funds are to be credited or debited for the tournament, but may not withdraw the funds before the tournament. In some such embodiments, the tournament facility may check whether sufficient funds are available to cover the players' losses or the amount of the buy-in for the tournament, such as through checking a financial account managed by the entity managing the online poker tournament and/or through using known techniques to check an external financial account for whether sufficient funds are available.

In block 126, the tournament facility plays the poker tournament, by playing a number of hands and interacting with the players (and the players' devices) to play the multiple hands of poker. As part of interacting with the devices, the tournament facility may exchange information with the devices, including providing information to the devices on a state of a hand and receiving information from the devices on actions to be taken by a player. Information that may be provided to a device may include information on cards dealt to a player and information on bets made by other players. Actions that may be taken by a player include actions relating to cards (e.g., dropping and drawing cards, when available under a tournament's rules) or actions relating to betting.

In accordance with techniques for operating a duration-limited online poker tournament, in block 128, at an outset of each hand, a number of chips available to each player for betting may be reset to a default number. Unlike traditional poker, where a player's wins or losses in prior hands will affect a number of chips in a current hand, in some duration-limited online poker tournaments operating as described herein, a number of chips available to a player is reset at the beginning of every round. When the number is reset, the number of chips available to a player may be updated in a data store (e.g., data store 102A of FIG. 1A) by recording that each player possesses the default number of chips. In addition, the tournament facility may output information triggering each of the client devices to update their displays to show to each player that the player has the default number of chips. The user interfaces of the client devices may display the number of chips available to a player in any suitable manner, including via text (e.g., a numeric value) and/or via one or more graphics (e.g., graphics of available chips, in different denominations).

During the play of a hand, actions taken by a player may reduce a number of chips available to that player for betting during that hand. In response, the tournament facility may trigger the client device for that player to update its user interface to reflect the reduced number of chips. In addition, the tournament facility may update a data store, in response to the betting action, to indicate a number of chips that remain to the player for betting as a result of the action.

Because in such embodiments the number of chips for each player is reset at an outset of each hand, players may be able to place bets that are unavailable in traditional poker games. For example, in some embodiments, a player may be able to place a bet during a hand that exceeds an amount of chips held by the player at an end of a preceding hand. The facility may only check for whether the bet is less than a number of chips held by the player during the current hand, following the reset of chips. Thus, the tournament facility may process any bet from a user during a hand, irrespective of a number of chips held by the player at the end of an immediately-preceding hand, which may include placing a bet of higher value than a player's total holdings at the end of the immediately-preceding hand.

In some embodiments, in addition to outputting a number of chips available to a player for betting, in block 130 the tournament facility may also trigger each of the client devices to output via their user interfaces a current standing of each player in the tournament. In traditional poker games, this separate value is unnecessary, as in a traditional poker game a number of chips available to a player for betting is directly linked to the player's standing in the tournament. In some embodiments described herein, though, because the number of chips available for betting is reset at the beginning of every hand, the user interface may also output to a player a current standing of the player and/or of other players in the tournament. The standings may be determined by the tournament facility in any suitable manner, including through processes described below with respect to FIGS. 2-4. Once the standings are calculated by the tournament facility, they may be output to the client devices such that the client devices may display the standings to the players. The standings may be updated following each hand.

Following the expiration of the duration for the duration-limited poker game, the tournament facility may calculate a score for each player. The score for each player may be calculated based on chips won and/or lost by the player during each of the hands of poker, such as through the processes described below with respect to FIGS. 2-4. In block 134, the tournament facility may determine amounts to credit and/or debit players' financial accounts. The facility may determine the amounts based on the scores of the players calculated in block 132. Examples of ways in which the amounts of funds may be calculated are described below in connection with FIGS. 2-4. In block 136, once the amounts of funds are calculated, the facility credits/debits the players' accounts. The crediting/debiting may be carried out in any suitable manner, including according to known techniques for performing financial transactions.

In some embodiments, in blocks 134, 136, only amounts to credit players' accounts may be calculated, as only winnings may be calculated. In other embodiments, though, a player's losses may also be calculated in block 134, 136. This may be the case when a player does not buy-in at a start of a tournament, but instead merely identifies a financial account to be debited as part of the tournament.

Figure 2:
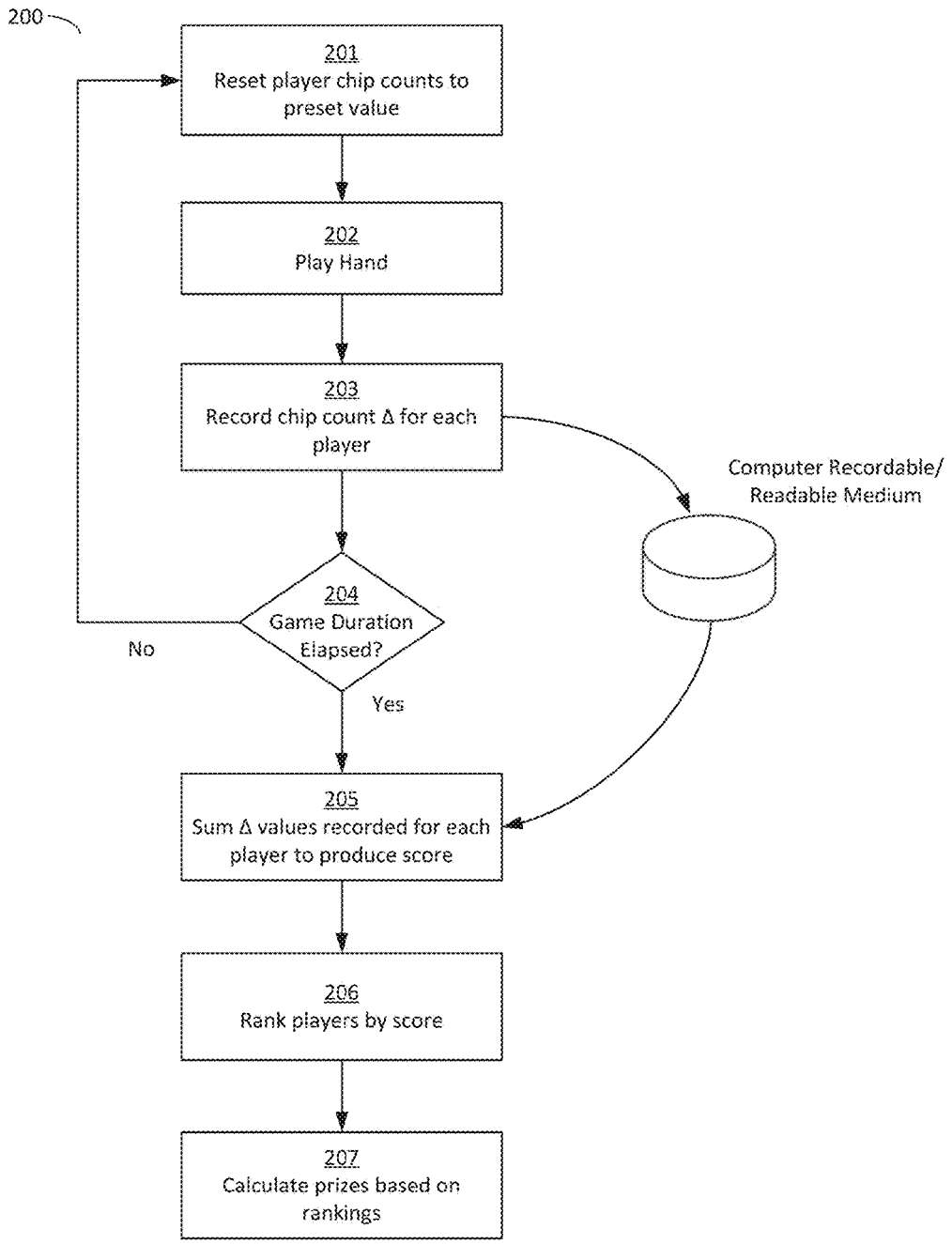
FIG. 2 is a flowchart of a first illustrative technique for calculating an overall score for each player of a poker tournament, by calculating a net score for each player based on results of each hand.

FIG. 2 is a flow chart depicting a first illustrative method of operating a tournament as described herein, according to some embodiments. Method 200 begins with act 201 in which a first hand is set up by giving all players the same preset number of chips. In act 202, the hand is played according to the rules of the poker game being played in the tournament. In act 203, once the hand has been played, the number of chips won or lost by each player is determined (indicated by a delta "A" in FIG. 2) and recorded on a computer readable/recordable medium or media. This may be performed by recording the change in the number of chips that the player net over the hand and/or by recording the absolute value of the player's chip stack at the end of the hand.

In act 204, it is determined whether the predetermined duration of the tournament has elapsed. As discussed above, such a duration may comprise a number of hands or a time duration. If the duration has not yet elapsed, method 200 returns to act 201 where the player's chip stacks are reset to the preset value and another hand is played in act 202, etc. If the duration has elapsed, the tournament has ended and in acts 205-207 prizes for each player are calculated.

In act 205, the values recorded within each occurrence of act 203 on the computer readable/recordable medium are retrieved and the values recorded for each player are summed together. Thus, the net amount won or lost over all of the played hands for each player is determined. Table 1 below illustrates an example poker tournament consisting of five hands and three players to demonstrate how such scores are collated. In Table 1, the values indicated are the net change in the player's chip stack by the end of each hand.

TABLE 1

| | Player A | Player B | Player C |
|---|---|---|---|
| Hand 1 | +50 | −40 | −10 |
| Hand 2 | 0 | −90 | +90 |
| Hand 3 | −5 | −15 | +20 |
| Hand 4 | −20 | +30 | −10 |
| Hand 5 | +100 | −20 | −80 |
| Net win/loss (Player Score) | +125 | −135 | +10 |

Note that in each hand of the illustrative tournament, the total of all players' changes in chip amounts total zero, as a player can only win chips if one or more other players lose the same amount of chips. This is naturally true for the net win/loss after the final hand as well, which is the player's score for the tournament that is calculated in act 205.

It will be appreciated that there are other suitable ways to calculate a player score not limited to the above-described illustrative approach. For example, the number of chips that each player has at the end of each hand may be recorded and summed at the end of the tournament. The player's score may then be determined by subtracting (the fixed number of chips that the player was given at the start of each hand multiplied by the number of hands). This is mathematically equivalent to the approach described in the table, and other such approaches may be envisioned as well.

In act 206, the players are ranked in order by their score. For example, in the tournament illustrated by Table 1, Player A may be ranked first, followed by Player C and then by Player B.

In act 207, prizes are determined based on the rankings, which comprises applying a predetermined prize schedule to the ranked list such that the first ranked player receives the first predetermined prize (which may be a fixed amount or a fixed portion of the available prize pool), the second ranked player receives the second predetermined prize, etc. Some of the predetermined prizes may be equal to zero.

For example, in the above illustrative tournament shown in Table 1, Player A may receive 75% of the available prize pool (since Player A is ranked first), Player C may receive 25% of the available prize pool (since Player C is ranked second) and Player B may receive 0% of the available prize pool (since Player B is ranked third). The available prize pool may include the total amount of money paid by the players to participate in the tournament, though may be subject to a rake such that the available prize pool is the total amount paid by the players minus a cut for an operator of the tournament. For example, the three players in the above example may each have paid $100 to participate in the tournament. Based on the illustrative allocation of the prize pool above, Player A would receive $225 (75% of $300), Player C would receive $75 (25% of $300) and Player B would receive nothing.

Figure 3:
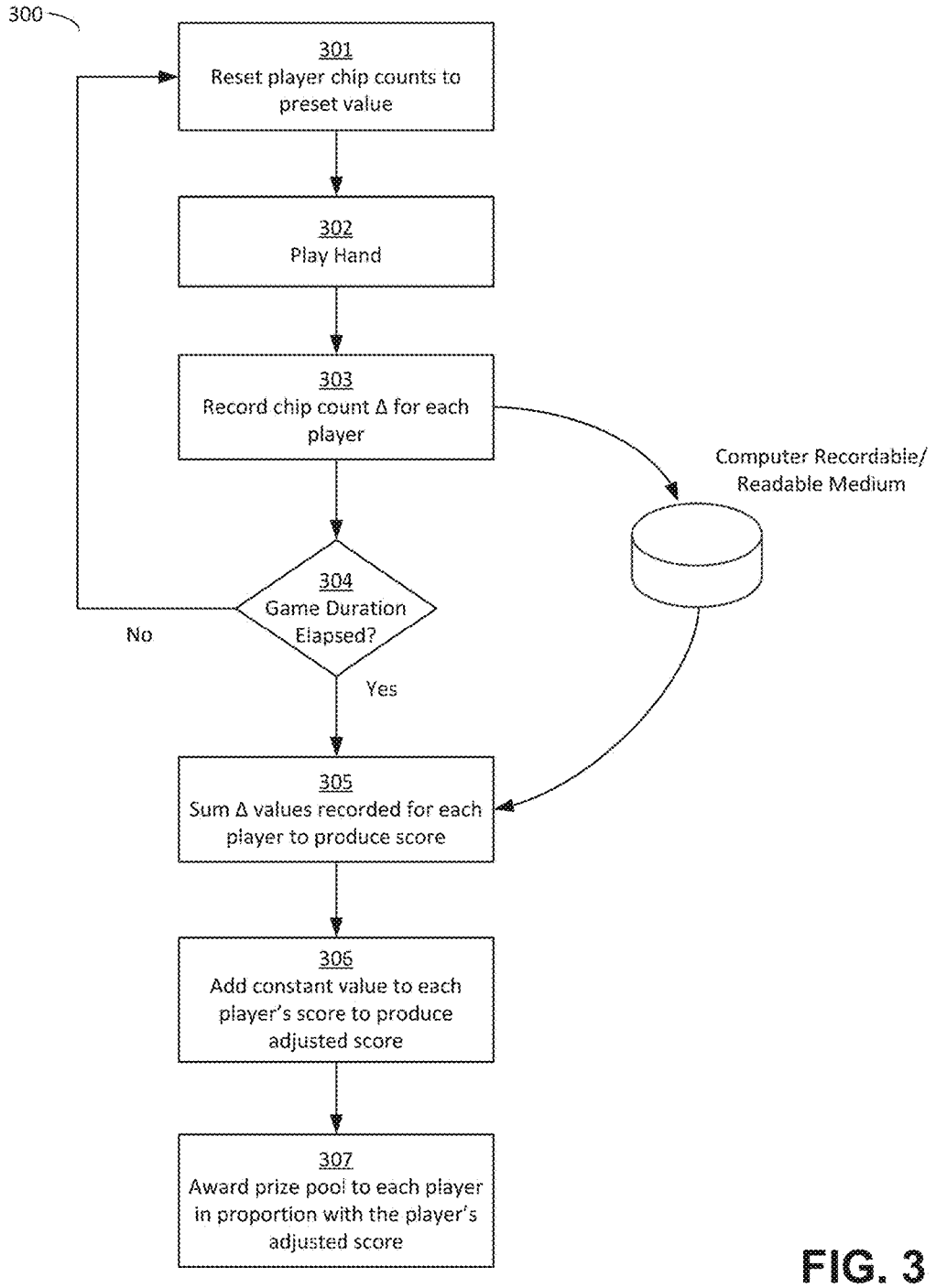
FIG. 3 is a flowchart of a second illustrative technique for calculating an overall score for each player of a poker tournament, by adding a constant value to each player's net score.

FIG. 3 is a flow chart depicting a second illustrative method of operating a tournament as described herein, according to some embodiments. Method 300 comprises acts 301-305 which are performed in the same manner described above for acts 201-205 in method 200 shown in FIG. 2.

In act 306, a constant value is added to each player's score to produce an adjusted score. The same constant value is added to each player's score. The constant value may be any suitable value and may be chosen, for example, based on expected scores of players at the end of a tournament. The constant value may, in some cases, be predetermined prior to commencement of the tournament.

In act 307, prizes are determined proportionately to each player's adjusted score. Thus if a player's adjusted score represents a particular fraction of the totals of all players' adjusted scores, that player would receive that fraction of the available prize pool.

Table 2 shown below illustrates an exemplary way to score and award prizes to players in an seven player tournament based on the approach shown in FIG. 3.

TABLE 2

| | $ Paid to Participate | Score | Score + Constant = Adjusted Score | % of Total Score | Prize |
|---|---|---|---|---|---|
| Player A | $10 | −50 | +950 | 14% | $9.50 |
| Player B | $10 | +100 | +1,100 | 16% | $11 |
| Player C | $10 | +200 | +1,200 | 17% | $12 |
| Player D | $10 | +500 | +1,500 | 21% | $15 |
| Player E | $10 | −650 | +350 | 5% | $3.50 |
| Player F | $10 | −350 | +650 | 9% | $6.50 |
| Player G | $10 | +250 | +1,250 | 18% | $12.50 |
| Total | $70 | 0 | +7,000 | 100% | $70 |

In this example, each of the seven players paid $10 to participate in the tournament. At the end of the tournament, the sum of net wins and/or losses for each player was calculated (act 305) and is shown in the column labeled "Score." A constant value of 1,000 is then added to the scores to produce adjusted scores (act 306). Then, the fraction that the adjusted score represents from the total of all the adjusted scores (7,000) is determined as the "% of Total Score." The prize for each player is then calculated as this fraction of the available prize pool. In the example of Table 2, Player A scored 14% of the total points (950 of 7,000) and so receives 14% of the $70 prize pool.

In some cases, negative adjusted scores may result if at least the lowest scoring player has a loss greater than the constant value added in act 306. These negative adjusted scores may be excluded from calculations of prize amounts such that the players with negative adjusted scores always receive a prize of $0.

Figure 4:
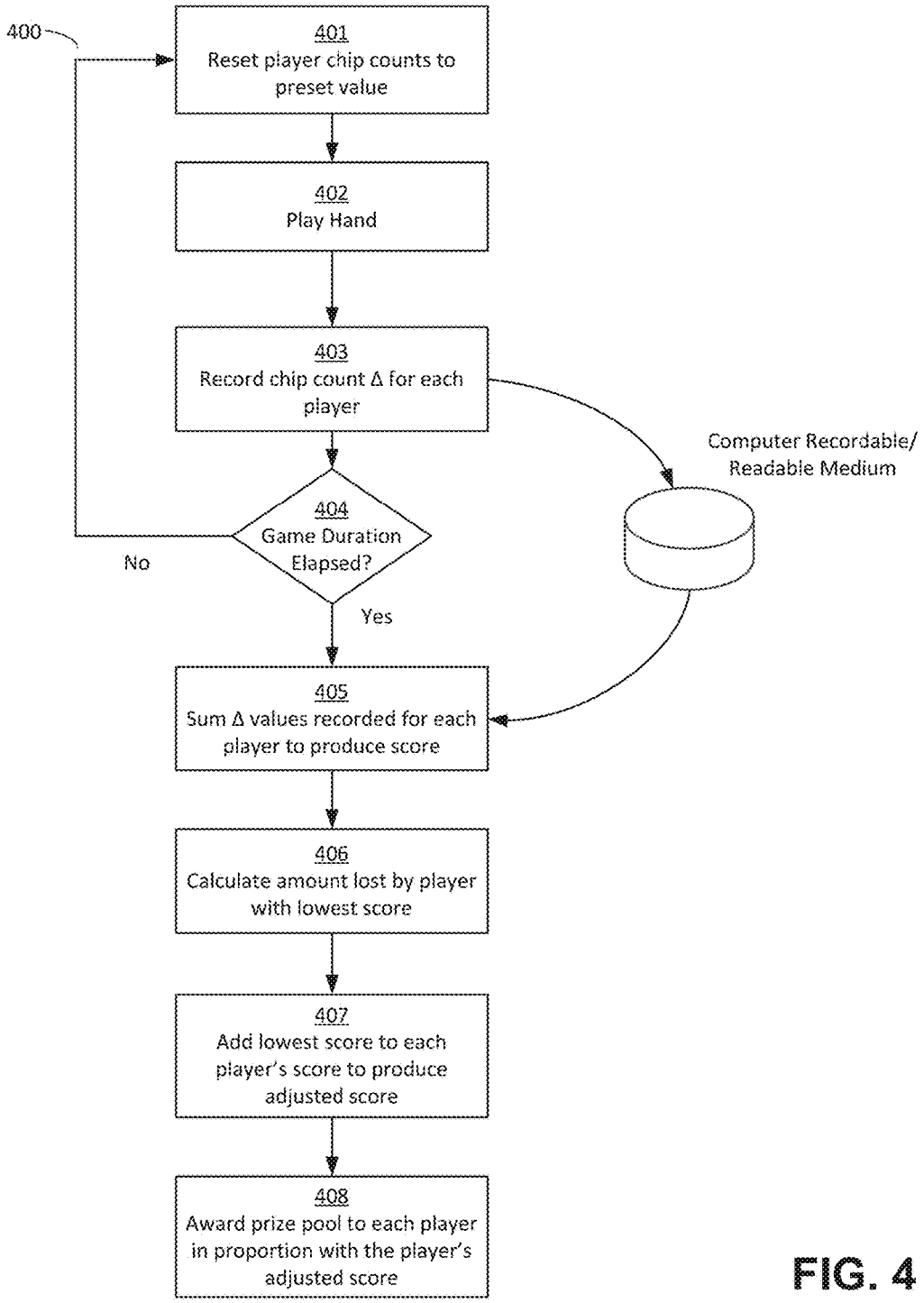
FIG. 4 is a flowchart of a third illustrative technique for calculating an overall score for each player of a poker tournament, by calculating adjusted scores for each based on a lowest player score.

FIG. 4 is a flow chart depicting a second illustrative method of operating a tournament as described herein, according to some embodiments. Method 400 comprises acts 401-405 which are performed in the same manner described above for acts 201-205 in method 200 shown in FIG. 2.

In act 406, the amount lost by the player with the lowest score is calculated, and in act 407 this amount is added to each player's score to produce an adjusted score. In act 408, prizes are determined proportionately to each player's adjusted score. Thus if a player's adjusted score represents a particular fraction of the totals of all players' adjusted scores, that player would receive that fraction of the available prize pool.

Table 3 shown below illustrates an exemplary way to score and award prizes to players in a ten player tournament based on the approach shown in FIG. 4.

TABLE 3

| | $ Paid to Participate | Score | Adjusted Score | % of Total Score | Prize |
|---|---|---|---|---|---|
| Player 1 | $10 | −5,000 | 0 | 0% | $0.00 |
| Player 2 | $10 | +4,000 | +9,000 | 18.0% | $18.00 |
| Player 3 | $10 | +275 | +5,275 | 10.6% | $10.55 |
| Player 4 | $10 | +2,000 | +7,000 | 14.0% | $14.00 |
| Player 5 | $10 | −3,000 | +2,000 | 4.0% | $4.00 |
| Player 6 | $10 | −240 | +4,760 | 9.5% | $9.52 |
| Player 7 | $10 | +850 | +5,850 | 11.7% | $11.70 |
| Player 8 | $10 | +1,665 | +6,665 | 13.3% | $13.33 |
| Player 9 | $10 | −2,000 | +3,000 | 6.0% | $6.00 |
| Player 10 | $10 | +1,450 | +6,450 | 12.9% | $12.90 |
| Total | $100 | 0 | +50,000 | 100% | $100 |

In this example, each of the ten players paid $10 to participate in the tournament. At the end of the tournament, the sum of net wins and/or losses for each player was calculated (act 405) and is shown in the column labeled "Score." The player with the highest loss is identified and their loss determined (act 406). In this case player 1 has the largest loss of 5,000. This value is then added to all of the player's scores to produce adjusted scores (act 407). As such, every player has a positive adjusted score with the player who had the lowest score (player 1 in this example) having an adjusted score of zero. Then, the fraction that the adjusted score represents from the total of all the adjusted scores (50,000) is determined as the "% of Total Score." The prize for each player is then calculated as this fraction of the available prize pool. In the example of Table 3, Player 2 scored 18% of the total adjusted score points (9,000 of 50,000) and so receives 18% of the $100 prize pool.

It will be appreciated that the techniques described herein may be applied to any suitable type of poker game having any number of players. The techniques are based upon recordation and calculation of the total wins and losses of a player over a number of hands and on a system in which players' chip totals are reset to a fixed amount at the start of every hand. Accordingly, such techniques are not limited to any particular type of poker game, nor any particular number of players.

In addition, the poker game may be played where the players are physically present in the same location (e.g., in a casino) or via a computer user interface (e.g., as "online" poker). Due to the computational and algorithmic nature of the techniques described herein, however, implementation of the techniques described herein to provide a computer-based poker tournament is highly preferable. Alternatively, when implemented in an environment in which players are physically present together, the techniques described herein are implemented within a computer that may, in some fashion, interface with the physical tournament taking place. For example, the number of chips won and/or lost by players may be automatically recorded via an electronic system such that the algorithms described herein for calculating may be applied to the recorded data.

An available prize pool may not, in some cases, be equal to the total amount paid by all players to enter the poker game. For example, a poker game may have an $11 entry fee, of which $10 goes toward the available prize pool and $1 is taken by the game organizer (e.g., casino) as a rake. Such a game may be presented, for example, as a "$10+$1" poker game.

Figure 5:
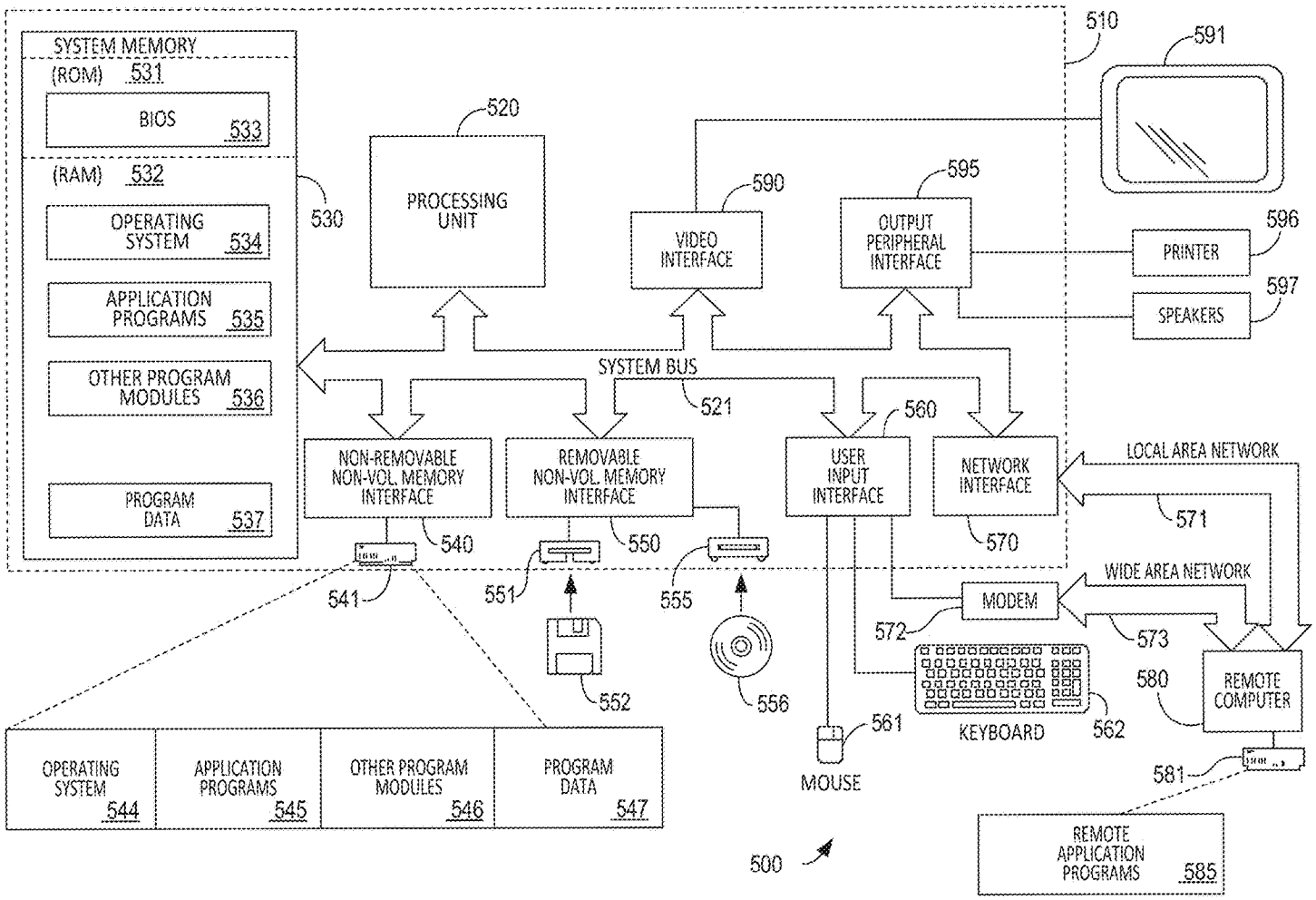
FIG. 5 is block diagram of an example of a computing device with which some embodiments may operate.

FIG. 5 illustrates an example of a suitable computing system environment 500 on which the technology described herein may be implemented. The computing system environment 500 is only one example of a suitable computing environment and is not intended to suggest any limitation as to the scope of use or functionality of the technology described herein. Neither should the computing environment 500 be interpreted as having any dependency or requirement relating to any one or combination of components illustrated in the illustrative operating environment 500.

The technology described herein is operational with numerous other general purpose or special purpose computing system environments or configurations. Examples of well-known computing systems, environments, and/or configurations that may be suitable for use with the technology described herein include, but are not limited to, personal computers, server computers, hand-held or laptop devices, multiprocessor systems, microprocessor-based systems, set top boxes, programmable consumer electronics, network PCs, minicomputers, mainframe computers, distributed computing environments that include any of the above systems or devices, and the like.

The computing environment may execute computer-executable instructions, such as program modules. Generally, program modules include routines, programs, objects, components, data structures, etc. that perform particular tasks or implement particular abstract data types. The technology described herein may also be practiced in distributed computing environments where tasks are performed by remote processing devices that are linked through a communications network. In a distributed computing environment, program modules may be located in both local and remote computer storage media including memory storage devices.

With reference to FIG. 5, an illustrative system for implementing the technology described herein includes a general purpose computing device in the form of a computer 510. Components of computer 510 may include, but are not limited to, a processing unit 520, a system memory 530, and a system bus 521 that couples various system components including the system memory to the processing unit 520. The system bus 521 may be any of several types of bus structures including a memory bus or memory controller, a peripheral bus, and a local bus using any of a variety of bus architectures. By way of example, and not limitation, such architectures include Industry Standard Architecture (ISA) bus, Micro Channel Architecture (MCA) bus, Enhanced ISA (EISA) bus, Video Electronics Standards Association (VESA) local bus, and Peripheral Component Interconnect (PCI) bus also known as Mezzanine bus.

Computer 510 typically includes a variety of computer readable media. Computer readable media can be any available media that can be accessed by computer 510 and includes both volatile and nonvolatile media, removable and non-removable media. By way of example, and not limitation, computer readable media may comprise computer storage media and communication media. Computer storage media includes volatile and nonvolatile, removable and non-removable media implemented in any method or technology for storage of information such as computer readable instructions, data structures, program modules or other data. Computer storage media includes, but is not limited to, RAM, ROM, EEPROM, flash memory or other memory technology, CD-ROM, digital versatile disks (DVD) or other optical disk storage, magnetic cassettes, magnetic tape, magnetic disk storage or other magnetic storage devices, or any other medium which can be used to store the desired information and which can accessed by computer 510. Communication media typically embodies computer readable instructions, data structures, program modules or other data in a modulated data signal such as a carrier wave or other transport mechanism and includes any information delivery media. The term "modulated data signal" means a signal that has one or more of its characteristics set or changed in such a manner as to encode information in the signal. By way of example, and not limitation, communication media includes wired media such as a wired network or direct-wired connection, and wireless media such as acoustic, RF, infrared and other wireless media. Combinations of the any of the above should also be included within the scope of computer readable media.

The system memory 530 includes computer storage media in the form of volatile and/or nonvolatile memory such as read only memory (ROM) 531 and random access memory (RAM) 532. A basic input/output system 533 (BIOS), containing the basic routines that help to transfer information between elements within computer 510, such as during start-up, is typically stored in ROM 531. RAM 532 typically contains data and/or program modules that are immediately accessible to and/or presently being operated on by processing unit 520. By way of example, and not limitation, FIG. 5 illustrates operating system 534, application programs 535, other program modules 536, and program data 537.

The computer 510 may also include other removable/non-removable, volatile/nonvolatile computer storage media. By way of example only, FIG. 5 illustrates a hard disk drive 541 that reads from or writes to non-removable, nonvolatile magnetic media, a magnetic disk drive 551 that reads from or writes to a removable, nonvolatile magnetic disk 552, and an optical disk drive 555 that reads from or writes to a removable, nonvolatile optical disk 556 such as a CD ROM or other optical media. Other removable/non-removable, volatile/nonvolatile computer storage media that can be used in the illustrative operating environment include, but are not limited to, magnetic tape cassettes, flash memory cards, digital versatile disks, digital video tape, solid state RAM, solid state ROM, and the like. The hard disk drive 541 is typically connected to the system bus 521 through a non-removable memory interface such as interface 540, and magnetic disk drive 551 and optical disk drive 555 are typically connected to the system bus 521 by a removable memory interface, such as interface 550.

The drives and their associated computer storage media discussed above and illustrated in FIG. 5, provide storage of computer readable instructions, data structures, program modules and other data for the computer 510. In FIG. 5, for example, hard disk drive 541 is illustrated as storing operating system 544, application programs 545, other program modules 546, and program data 547. Note that these components can either be the same as or different from operating system 534, application programs 535, other program modules 536, and program data 537. Operating system 544, application programs 545, other program modules 546, and program data 547 are given different numbers here to illustrate that, at a minimum, they are different copies. A user may enter commands and information into the computer 510 through input devices such as a keyboard 562 and pointing device 561, commonly referred to as a mouse, trackball or touch pad. Other input devices (not shown) may include a microphone, joystick, game pad, satellite dish, scanner, or the like. These and other input devices are often connected to the processing unit 520 through a user input interface 560 that is coupled to the system bus, but may be connected by other interface and bus structures, such as a parallel port, game port or a universal serial bus (USB). A monitor 591 or other type of display device is also connected to the system bus 521 via an interface, such as a video interface 590. In addition to the monitor, computers may also include other peripheral output devices such as speakers 597 and printer 596, which may be connected through an output peripheral interface 595.

The computer 510 may operate in a networked environment using logical connections to one or more remote computers, such as a remote computer 580. The remote computer 580 may be a personal computer, a server, a router, a network PC, a peer device or other common network node, and typically includes many or all of the elements described above relative to the computer 510, although only a memory storage device 581 has been illustrated in FIG. 5. The logical connections depicted in FIG. 5 include a local area network (LAN) 571 and a wide area network (WAN) 573, but may also include other networks. Such networking environments are commonplace in offices, enterprise-wide computer networks, intranets and the Internet.

When used in a LAN networking environment, the computer 510 is connected to the LAN 571 through a network interface or adapter 570. When used in a WAN networking environment, the computer 510 typically includes a modem 572 or other means for establishing communications over the WAN 573, such as the Internet. The modem 572, which may be internal or external, may be connected to the system bus 521 via the user input interface 560, or other appropriate mechanism. In a networked environment, program modules depicted relative to the computer 510, or portions thereof, may be stored in the remote memory storage device. By way of example, and not limitation, FIG. 5 illustrates remote application programs 585 as residing on memory device 581. It will be appreciated that the network connections shown are illustrative and other means of establishing a communications link between the computers may be used.

Having thus described several aspects of at least one embodiment, it is to be appreciated that various alterations, modifications, and improvements will readily occur to those skilled in the art.

Such alterations, modifications, and improvements are intended to be part of this disclosure, and are intended to be within the spirit and scope of the disclosure. Further, though advantages are indicated, it should be appreciated that not every embodiment of the technology described herein will include every described advantage. Some embodiments may not implement any features described as advantageous herein and in some instances one or more of the described features may be implemented to achieve further embodiments. Accordingly, the foregoing description and drawings are by way of example only.

The above-described embodiments of the technology described herein can be implemented in any of numerous ways. For example, the embodiments may be implemented using hardware, software or a combination thereof. When implemented in software, the software code can be executed on any suitable processor or collection of processors, whether provided in a single computer or distributed among multiple computers. Such processors may be implemented as integrated circuits, with one or more processors in an integrated circuit component, including commercially available integrated circuit components known in the art by names such as CPU chips, GPU chips, microprocessor, microcontroller, or co-processor. Alternatively, a processor may be implemented in custom circuitry, such as an ASIC, or semi-custom circuitry resulting from configuring a programmable logic device. As yet a further alternative, a processor may be a portion of a larger circuit or semiconductor device, whether commercially available, semi-custom or custom. As a specific example, some commercially available microprocessors have multiple cores such that one or a subset of those cores may constitute a processor. Though, a processor may be implemented using circuitry in any suitable format.

Further, it should be appreciated that a computer may be embodied in any of a number of forms, such as a rack-mounted computer, a desktop computer, a laptop computer, or a tablet computer. Additionally, a computer may be embedded in a device not generally regarded as a computer but with suitable processing capabilities, including a Personal Digital Assistant (PDA), a smart phone or any other suitable portable or fixed electronic device.

Also, a computer may have one or more input and output devices. These devices can be used, among other things, to present a user interface. Examples of output devices that can be used to provide a user interface include printers or display screens for visual presentation of output and speakers or other sound generating devices for audible presentation of output. Examples of input devices that can be used for a user interface include keyboards, and pointing devices, such as mice, touch pads, and digitizing tablets. As another example, a computer may receive input information through speech recognition or in other audible format.

Such computers may be interconnected by one or more networks in any suitable form, including as a local area network or a wide area network, such as an enterprise network or the Internet. Such networks may be based on any suitable technology and may operate according to any suitable protocol and may include wireless networks, wired networks or fiber optic networks.

Also, the various methods or processes outlined herein may be coded as software that is executable on one or more processors that employ any one of a variety of operating systems or platforms. Additionally, such software may be written using any of a number of suitable programming languages and/or programming or scripting tools, and also may be compiled as executable machine language code or intermediate code that is executed on a framework or virtual machine.

In this respect, embodiments may be implemented as a computer readable storage medium (or multiple computer readable media) (e.g., a computer memory, one or more floppy discs, compact discs (CD), optical discs, digital video disks (DVD), magnetic tapes, flash memories, circuit configurations in Field Programmable Gate Arrays or other semiconductor devices, or other tangible computer storage medium) encoded with one or more programs that, when executed on one or more computers or other processors, perform methods that implement the various embodiments discussed above. As is apparent from the foregoing examples, a computer readable storage medium may retain information for a sufficient time to provide computer-executable instructions in a non-transitory form. Such a computer readable storage medium or media can be transportable, such that the program or programs stored thereon can be loaded onto one or more different computers or other processors to implement various embodiments as discussed above. As used herein, the term "computer-readable storage medium" encompasses only a non-transitory computer-readable medium that can be considered to be a manufacture (i.e., article of manufacture) or a machine. Alternatively or additionally, embodiments may be implemented as a computer readable medium other than a computer-readable storage medium, such as a propagating signal.

The terms "program" or "software" are used herein in a generic sense to refer to any type of computer code or set of computer-executable instructions that can be employed to program a computer or other processor to implement various embodiments as discussed above. Additionally, it should be appreciated that according to one aspect of this embodiment, one or more computer programs that when executed perform methods need not reside on a single computer or processor, but may be distributed in a modular fashion amongst a number of different computers or processors to implement various embodiments.

Computer-executable instructions may be in many forms, such as program modules, executed by one or more computers or other devices. Generally, program modules include routines, programs, objects, components, data structures, etc. that perform particular tasks or implement particular abstract data types. Typically the functionality of the program modules may be combined or distributed as desired in various embodiments.

Also, data structures may be stored in computer-readable media in any suitable form. For simplicity of illustration, data structures may be shown to have fields that are related through location in the data structure. Such relationships may likewise be achieved by assigning storage for the fields with locations in a computer-readable medium that conveys relationship between the fields. However, any suitable mechanism may be used to establish a relationship between information in fields of a data structure, including through the use of pointers, tags or other mechanisms that establish relationship between data elements.

Various embodiments may be used alone, in combination, or in a variety of arrangements not specifically discussed in the embodiments described in the foregoing and is therefore not limited in its application to the details and arrangement of components set forth in the foregoing description or illustrated in the drawings. For example, aspects described in one embodiment may be combined in any manner with aspects described in other embodiments.

Also, the embodiments may be implemented as a method, of which an example has been provided. The acts performed as part of the method may be ordered in any suitable way. Accordingly, embodiments may be constructed in which acts are performed in an order different than illustrated, which may include performing some acts simultaneously, even though shown as sequential acts in illustrative embodiments.

The phraseology and terminology used herein is for the purpose of description and should not be regarded as limiting. The use of "including," "comprising," or "having," "containing," "involving," and variations thereof herein, is meant to encompass the items listed thereafter and equivalents thereof as well as additional items.

What is claimed is:

1. A method of operating a system of distributed computers in a duration-limited online poker tournament including a plurality of distributed players for a set period of time, the system of distributed computers comprising a plurality of client devices each operated by a player of the plurality of distributed players, the method comprising:

receiving, for each player of the plurality of distributed players, an indication of a financial account to be credited based on the player's performance in the duration-limited online poker tournament;

interacting with the plurality of distributed players for the set period of time, wherein interacting with the plurality of distributed players comprises playing a plurality of hands of poker, wherein playing the plurality of hands of poker comprises, for each hand of the plurality of hands:

at an outset of the hand and for each player of the plurality of distributed players, resetting, to a default number, a number of chips made available to the player for betting during the hand, wherein resetting to the default number comprises recording, in at least one data store, that a number of chips currently available to each player for betting is equal to the default number;

interacting with the plurality of client devices of the plurality of distributed players to present to each player cards that have been dealt to each player and to receive from each player an identification of one or more actions to be taken by the player during the hand, wherein the one or more actions comprise one or more actions related to betting and/or one or more actions related to the player's cards, wherein interacting with the plurality of distributed players comprises exchanging messages with the plurality of client devices via one or more networks, and wherein in a case that an action taken by a player is a betting action, the interacting comprises determining, based on the betting action, an updated value for the number of chips currently available to the player for betting and recording the updated value for the player in the at least one data store;

determining, following the interacting with the plurality of distributed players, a winner of the hand in accordance with poker rules for the duration-limited online poker tournament; and recording, for each player, a number of chips won or lost by the player as a result of betting by the player during the hand;

determining, following the set period of time for the duration-limited online poker tournament, a score for each player of the plurality of distributed players, wherein determining the score for each player comprises, for each player, evaluating the number of chips won or lost by the player across each hand of the plurality of hands;

determining an amount of funds to credit a financial account of each player, of the plurality of distributed players, based on the score for each player; and crediting the financial accounts for the plurality of distributed players based on the amount of funds calculated for each player of the plurality of distributed players.

2. The method of claim 1, wherein the plurality of distributed players are geographically distributed, at least some of the plurality of distributed players being geographically remote from others.

3. The method of claim 1, wherein determining the score for each player comprises determining a net number of chips won and/or lost by each player across the plurality of hands.

4. The method of claim 3, wherein determining the score for each player further comprises adding a constant value, for each player, to the net number of chips won and/or lost by that player.

5. The method of claim 4, further comprising:

determining the constant value based on the net number of chips won and/or lost by that player, wherein determining the constant value comprises, in response to determining that two or more of the net number of chips are less than zero, determining a greatest absolute value from among the two or more net number of chips; and selecting the constant value to be greater than or equal to the greatest absolute value.

6. The method of claim 1, wherein determining an amount of funds to credit a financial account of each player, of the plurality of distributed players, based on the score for each player comprises:

ranking the plurality of distributed players based on the score for each player; and assigning amounts of funds based on the ranking.

7. The method of claim 1, wherein determining an amount of funds to credit a financial account of each player, of the plurality of distributed players, based on the score for each player comprises:

calculating, for each player of the plurality of distributed players, a normalized score for each player based at least in part on the scores for each of the plurality of distributed players; and assigning amounts of funds based on the normalized score for each player.

8. The method of claim 7, wherein calculating the normalized score for each player comprises:

for each player, calculating an adjusted score by adding a constant value to the net number of chips won and/or lost by the player;

summing the adjusted scores for the plurality of distributed players to yield a summed score; and for each player, calculating the normalized score as a ratio of the adjusted score for the player to the summed score.

9. The method of claim 8, wherein recording, for each player, the number of chips won or lost by the player as a result of betting by the player during the hand comprises calculating a difference between a number of chips held by the player at an end of the hand and the default number of chips, the difference being a positive value in a case that the player gained chips during the hand and being a negative value in a case that the player lost chips during the hand.

10. The method of claim 1, wherein playing the plurality of hands of poker further comprises, for each hand of the plurality of hands and at the outset of the hand and for each player of the plurality of distributed players, outputting for display via a user interface an indication that the player currently holds, for betting during the hand, the default number of chips.

11. The method of claim 10, further comprising:

outputting for display to each player, via the user interface and during the set period of time, a current overall score for the player during the poker tournament.

12. The method of claim 1, wherein receiving, for each player of the plurality of distributed players, the indication of the financial account to be credited based on the player's performance in the duration-limited online poker tournament comprises receiving a payment from the financial account.

13. The method of claim 12, wherein receiving the payment from the financial account comprises receiving the payment via a payment interface of a respective client device of the plurality of client devices.

14. The method of claim 1, further comprising:

receiving administrator input establishing a plurality of settings for the duration-limited online poker tournament, wherein the plurality of settings comprise a buy-in amount, the default number of chips, and a length of the set period of time, wherein the default number of chips is independent of the buy-in amount and the length of the set period of time is specified as an amount of time and/or a number of hands to be played.

15. The method of claim 1, wherein playing the plurality of hands comprises, in response to receiving from a player an identification of a betting action to be taken by the player during a hand, performing the betting action even in a case that an amount to be bet by the player in the betting action exceeds an amount of chips held by the player at an end of a preceding hand.

16. At least one computer-readable storage medium having encoded thereon executable instructions that, when executed by at least one processor, cause the at least one processor to carry out a method of operating a system of distributed computers in a duration-limited online poker tournament including a plurality of distributed players for a set period of time, the system of distributed computers comprising a plurality of client devices each operated by a player of the plurality of distributed players, the method comprising:

receiving, for each player of the plurality of distributed players, an indication of a financial account to be credited based on the player's performance in the duration-limited online poker tournament;

interacting with the plurality of distributed players for the set period of time, wherein interacting with the plurality of distributed players comprises playing a plurality of hands of poker, wherein playing the plurality of hands of poker comprises, for each hand of the plurality of hands:

at an outset of the hand and for each player of the plurality of distributed players, resetting, to a default number, a number of chips made available to the player for betting during the hand, wherein resetting to the default number comprises recording, in at least one data store, that a number of chips currently available to each player for betting is equal to the default number;

interacting with the plurality of client devices of the plurality of distributed players to present to each player cards that have been dealt to each player and to receive from each player an identification of one or more actions to be taken by the player during the hand, wherein the one or more actions comprise one or more actions related to betting and/or one or more actions related to the player's cards, wherein interacting with the plurality of distributed players comprises exchanging messages with the plurality of client devices via one or more networks, and wherein in a case that an action taken by a player is a betting action, the interacting comprises determining, based on the betting action, an updated value for the number of chips currently available to the player for betting and recording the updated value for the player in the at least one data store;

determining, following the interacting with the plurality of distributed players, a winner of the hand in accordance with poker rules for the duration-limited online poker tournament; and recording, for each player, a number of chips won or lost by the player as a result of betting by the player during the hand;

determining, following the set period of time for the duration-limited online poker tournament, a score for each player of the plurality of distributed players, wherein determining the score for each player comprises, for each player, evaluating the number of chips won or lost by the player across each hand of the plurality of hands;

determining an amount of funds to credit a financial account of each player, of the plurality of distributed players, based on the score for each player; and crediting the financial accounts for the plurality of distributed players based on the amount of funds calculated for each player of the plurality of distributed players.

17. An apparatus comprising:

at least one processor; and at least one storage medium having encoded thereon executable instructions that, when executed by the at least one processor, cause the at least one processor to carry out a method of operating a system of distributed computers in a duration-limited online poker tournament including a plurality of distributed players for a set period of time, the system of distributed computers comprising a plurality of client devices each operated by a player of the plurality of distributed players, the method comprising:

receiving, for each player of the plurality of distributed players, an indication of a financial account to be credited based on the player's performance in the duration-limited online poker tournament;

interacting with the plurality of distributed players for the set period of time, wherein interacting with the plurality of distributed players comprises playing a plurality of hands of poker, wherein playing the plurality of hands of poker comprises, for each hand of the plurality of hands:

at an outset of the hand and for each player of the plurality of distributed players, resetting, to a default number, a number of chips made available to the player for betting during the hand, wherein resetting to the default number comprises recording, in at least one data store, that a number of chips currently available to each player for betting is equal to the default number;

interacting with the plurality of client devices of the plurality of distributed players to present to each player cards that have been dealt to each player and to receive from each player an identification of one or more actions to be taken by the player during the hand, wherein the one or more actions comprise one or more actions related to betting and/or one or more actions related to the player's cards, wherein interacting with the plurality of distributed players comprises exchanging messages with the plurality of client devices via one or more networks, and wherein in a case that an action taken by a player is a betting action, the interacting comprises determining, based on the betting action, an updated value for the number of chips currently available to the player for betting and recording the updated value for the player in the at least one data store;

determining, following the interacting with the plurality of distributed players, a winner of the hand in accordance with poker rules for the duration-limited online poker tournament; and recording, for each player, a number of chips won or lost by the player as a result of betting by the player during the hand;

determining, following the set period of time for the duration-limited online poker tournament, a score for each player of the plurality of distributed players, wherein determining the score for each player comprises, for each player, evaluating the number of chips won or lost by the player across each hand of the plurality of hands;

determining an amount of funds to credit a financial account of each player, of the plurality of distributed players, based on the score for each player; and crediting the financial accounts for the plurality of distributed players based on the amount of funds calculated for each player of the plurality of distributed players.

18. The method of claim 13, wherein receiving the payment from the financial account via the payment interface of the respective client device comprises receiving the payment via a payment slot of the payment interface.

19. The at least one computer-readable storage medium of claim 16, wherein receiving, for each player of the plurality of distributed players, the indication of the financial account to be credited based on the player's performance in the duration-limited online poker tournament comprises receiving a payment from the financial account via a payment interface of a respective client device of the plurality of client devices.

20. The apparatus of claim 17, wherein receiving, for each player of the plurality of distributed players, the indication of the financial account to be credited based on the player's performance in the duration-limited online poker tournament comprises receiving a payment from the financial account via a payment interface of a respective client device of the plurality of client devices.

* * * * *